US007967001B2

(12) United States Patent
Scherer et al.

(10) Patent No.: US 7,967,001 B2
(45) **Date of Patent: *Jun. 28, 2011**

(54) BLOCK SPLITTING ASSEMBLY AND METHOD

(75) Inventors: Ronald J. Scherer, Oak Park Heights, MN (US); David Matthew LaCroix, Circle Pines, MN (US); Michael J. Hogan, Minnetonka, MN (US); Glenn C. Bolles, Edina, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/952,742

(22) Filed: Nov. 23, 2010

(65) Prior Publication Data

US 2011/0061640 A1 Mar. 17, 2011

Related U.S. Application Data

(60) Continuation of application No. 11/926,491, filed on Oct. 29, 2007, which is a division of application No. 11/297,121, filed on Dec. 7, 2005, now abandoned, which is a continuation of application No. 11/030,739, filed on Jan. 6, 2005, now Pat. No. 7,066,167, which is a continuation of application No. 09/884,795, filed on Jun. 19, 2001, now Pat. No. 6,918,715, which is a continuation-in-part of application No. 09/691,864, filed on Oct. 19, 2000, now Pat. No. 6,910,474, which is a continuation-in-part of application No. 09/330,879, filed on Jun. 11, 1999, now Pat. No. 6,321,740.

(51) Int. Cl.
*B28D 1/26* (2006.01)

(52) U.S. Cl. ..... 125/23.01; 125/40; 125/24

(58) Field of Classification Search ..... 125/23.01, 125/24, 40, 42, 30.01
See application file for complete search history.

(56) References Cited

U.S. PATENT DOCUMENTS

| | | | |
|---|---|---|---|
| 415,773 | A | 11/1889 | Fiske |
| 511,098 | A | 12/1893 | Shultz |
| 534,462 | A | 2/1895 | Balsley |
| 787,199 | A | 4/1905 | Lloyd |
| 803,014 | A | 10/1905 | McIlravy |
| 806,951 | A | 12/1905 | Bryning |
| 1,086,975 | A | 2/1914 | Aaronson |

(Continued)

FOREIGN PATENT DOCUMENTS

CA 1 194 703 10/1985

(Continued)

OTHER PUBLICATIONS

"Country Manor" product brochure, Anchor Concrete Products, Inc., 8 pages, 2000 copyright notice.

(Continued)

*Primary Examiner* — Eileen P. Morgan
(74) *Attorney, Agent, or Firm* — Merchant & Gould P.C.

(57) ABSTRACT

A masonry block that is produced from a workpiece that is split in a block splitting assembly which uses any of a variety of projections to supplement or replace the action of the splitting blade in splitting and dressing the workpiece. The resulting masonry block has features that provide the masonry block with a weathered appearance.

14 Claims, 22 Drawing Sheets

U.S. PATENT DOCUMENTS

| | | | | | |
|---|---|---|---|---|---|
| 1,092,621 | A | | 4/1914 | Worner | |
| 1,287,055 | A | | 12/1918 | Lehman | |
| 1,534,353 | A | | 4/1925 | Besser | |
| 1,872,522 | A | | 8/1932 | Stuckey | |
| 2,219,606 | A | | 10/1940 | Schoick | |
| 2,313,363 | A | | 3/1943 | Schmitt | |
| 2,593,606 | A | | 4/1952 | Price | |
| 2,775,236 | A | | 12/1956 | Blum | |
| 2,881,753 | A | | 4/1959 | Entz | |
| 2,888,916 | A | * | 6/1959 | Entz | 125/23.01 |
| 2,925,080 | A | | 2/1960 | Smith | |
| 3,095,868 | A | * | 7/1963 | Mangis | 125/23.01 |
| 3,120,842 | A | | 2/1964 | Cox et al. | |
| 3,392,719 | A | | 7/1968 | Clanton et al. | |
| 3,425,105 | A | | 2/1969 | Gulde | |
| 3,559,631 | A | | 2/1971 | Mangis | |
| 3,727,600 | A | * | 4/1973 | Schlough | 125/23.01 |
| 3,809,049 | A | * | 5/1974 | Fletcher et al. | 125/23.01 |
| 3,940,229 | A | | 2/1976 | Hutton | |
| 3,981,953 | A | | 9/1976 | Haines | |
| 4,023,767 | A | | 5/1977 | Fontana | |
| 4,050,864 | A | | 9/1977 | Komaki | |
| 4,098,865 | A | | 7/1978 | Repasky | |
| 4,114,773 | A | | 9/1978 | Sekiguchi | |
| 4,139,593 | A | | 2/1979 | Holz et al. | |
| 4,178,340 | A | | 12/1979 | Hyytinen | |
| 4,193,718 | A | | 3/1980 | Wahrendorf et al. | |
| 4,243,012 | A | * | 1/1981 | Keck | 125/23.01 |
| 4,250,863 | A | | 2/1981 | Gagnon et al. | |
| 4,335,549 | A | | 6/1982 | Dean, Jr. | |
| 4,343,287 | A | * | 8/1982 | Hallberg et al. | 125/23.01 |
| 4,524,551 | A | | 6/1985 | Scheiwiller | |
| 4,770,218 | A | | 9/1988 | Duerr | |
| 4,784,821 | A | | 11/1988 | Leopold | |
| D299,067 | S | | 12/1988 | Forsberg | |
| 4,848,309 | A | | 7/1989 | Alderete | |
| 4,869,660 | A | | 9/1989 | Ruckstuhl | |
| 5,017,049 | A | | 5/1991 | Sievert | |
| 5,028,172 | A | | 7/1991 | Wilson et al. | |
| 5,031,376 | A | | 7/1991 | Bender et al. | |
| 5,056,998 | A | | 10/1991 | Goossens | |
| 5,066,070 | A | | 11/1991 | Clarke | |
| 5,078,940 | A | | 1/1992 | Sayles | |
| 5,152,275 | A | * | 10/1992 | Landhuis | 125/12 |
| 5,158,132 | A | | 10/1992 | Guillemot | |
| 5,217,630 | A | | 6/1993 | Sayles | |
| 5,413,086 | A | | 5/1995 | Trudeau | |
| 5,534,214 | A | | 7/1996 | Sakamoto et al. | |
| 5,662,094 | A | | 9/1997 | Giacomelli | |
| 5,709,062 | A | | 1/1998 | Woolford | |
| 5,722,386 | A | * | 3/1998 | Fladgard et al. | 125/23.01 |
| 5,735,643 | A | | 4/1998 | Castonguay et al. | |
| 5,788,423 | A | | 8/1998 | Perkins | |
| 5,827,015 | A | | 10/1998 | Woolford et al. | |
| D404,146 | S | | 1/1999 | Perkins | |
| 5,879,603 | A | | 3/1999 | Sievert | |
| 6,024,517 | A | * | 2/2000 | Castonguay et al. | 405/286 |
| 6,029,943 | A | | 2/2000 | Sievert | |
| 6,050,255 | A | * | 4/2000 | Sievert | 125/23.01 |
| 6,082,057 | A | | 7/2000 | Sievert | |
| 6,102,026 | A | * | 8/2000 | Fladgard et al. | 125/23.01 |
| 6,113,379 | A | | 9/2000 | LaCroix et al. | |
| 6,138,983 | A | | 10/2000 | Sievert | |
| 6,142,713 | A | | 11/2000 | Woolford et al. | |
| 6,149,352 | A | | 11/2000 | MacDonald | |
| 6,151,784 | A | * | 11/2000 | Maruyama | 30/134 |
| D438,640 | S | | 3/2001 | Bolles et al. | |
| 6,209,848 | B1 | | 4/2001 | Bolles et al. | |
| 6,224,815 | B1 | | 5/2001 | LaCroix et al. | |
| 6,240,913 | B1 | * | 6/2001 | Snell | 125/23.01 |
| 6,321,740 | B1 | * | 11/2001 | Scherer et al. | 125/40 |
| D464,145 | S | | 10/2002 | Scherer et al. | |
| 6,464,199 | B1 | | 10/2002 | Johnson | |
| D482,133 | S | | 11/2003 | Scherer et al. | |
| 6,668,816 | B1 | | 12/2003 | Pedersen et al. | |
| 6,827,073 | B1 | * | 12/2004 | Morrell | 125/23.01 |
| 6,910,474 | B1 | | 6/2005 | Scherer | |
| 6,918,715 | B2 | | 7/2005 | Scherer | |
| D513,805 | S | | 1/2006 | Scherer et al. | |
| 7,066,167 | B2 | | 6/2006 | Scherer et al. | |
| 2008/0302350 | A1 | | 12/2008 | LaCroix | |

FOREIGN PATENT DOCUMENTS

| | | | |
|---|---|---|---|
| CA | 1 197 391 | | 12/1985 |
| CH | 663 437 | | 12/1987 |
| DE | 1 950 950 | | 6/1970 |
| DE | 90 15 196 | | 4/1991 |
| EP | 0 294 267 | A1 | 12/1988 |
| GB | 970595 | | 9/1964 |
| GB | 1492652 | | 4/1976 |
| GB | 1 509 747 | | 5/1978 |
| GB | 2258184 | | 2/1993 |
| JP | H6-24912 | | 4/1994 |
| JP | 09038922 | | 2/1997 |
| JP | 2000-61934 | | 2/2000 |
| WO | WO 00/47825 | | 8/2000 |

OTHER PUBLICATIONS

EP Henry 2001 product brochure, EP Henry Corp., pp. 1-49.

"Country Manor Design and Construction Manual", Keystone Retaining Wall Systems, Inc., 2001 copyright notice.

"Roman Stackstone", Mutual Materials Co., 1 page, possibly Mar. 2000.

Patio Town Price Catalog 2001, pp. 1-10.

"Rustic" product literature, Rockwood Retaining Walls, Inc., 1 sheet, 2000 copyright notice.

"Technical Data for the Blockmaker", *Besser Company*, 4 pgs. (1982).

* cited by examiner

BLOCK SPLITTING ASSEMBLY AND METHOD

CROSS REFERENCE TO RELATED APPLICATIONS

This application is a continuation of U.S. patent application Ser. No. 11/926,491, filed Oct. 29, 2007, which is a divisional of U.S. patent application Ser. No. 11/297,121, filed Dec. 7, 2005, now abandoned, which is a continuation application of U.S. patent application Ser. No. 11/030,739, filed Jan. 6, 2005, issued as U.S. Pat. No. 7,066,167, which is a continuation application of U.S. patent application Ser. No. 09/884,795, filed Jun. 19, 2001, issued as U.S. Pat. No. 6,918,715, which is a continuation-in-part of U.S. patent application Ser. No. 09/691,864, filed Oct. 19, 2000, issued as U.S. Pat. No. 6,910,474, which is a continuation-in-part of U.S. patent application Ser. No. 09/330,879, filed Jun. 11, 1999, issued as U.S. Pat. No. 6,321,740, which applications are hereby incorporated by reference in their entirety.

FIELD OF THE INVENTION

The invention relates generally to manufacture of masonry block. More specifically, it relates to equipment and processes for the creation of decorative faces on masonry block. Even more specifically, the invention relates to equipment and processes for producing roughened textures and the appearance of weathered or rock-like edges on masonry block, as well as to masonry blocks that result from such equipment and processes.

BACKGROUND OF THE INVENTION

It has become rather common to use concrete masonry blocks for landscaping purposes. Such blocks are used to create, for example, retaining walls, ranging from comparatively large structures to small tree ring walls and garden edging walls. Concrete masonry blocks are made in high speed production plants, and typically are exceedingly uniform in appearance. This is not an undesirable characteristic in some landscaping applications, but it is a drawback in many applications where there is a demand for a "natural" appearance to the material used to construct the walls and other landscaping structures.

One way to make concrete masonry blocks less uniform, and more "natural" appearing, is to use a splitting process to create a "rock-face" on the block. In this process, as it is commonly practiced, a large concrete workpiece which has been adequately cured is split or cracked apart to form two blocks. The resulting faces of the resulting two blocks along the plane of splitting or cracking are textured and irregular, so as to appear "rock-like". This process of splitting a workpiece into two masonry blocks to create a rock-like appearance on the exposed faces of the blocks is shown, for example, in Besser's U.S. Pat. No. 1,534,353, which discloses the manual splitting of blocks using a hammer and chisel.

Automated equipment to split block is well-known, and generally includes splitting apparatus comprising a supporting table and opposed, hydraulically-actuated splitting blades. A splitting blade in this application is typically a substantial steel plate that is tapered to a relatively narrow or sharp knife edge. The blades typically are arranged so that the knife edges will engage the top and bottom surfaces of the workpiece in a perpendicular relationship with those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cracks), generally along the plane of alignment of the blades.

These machines are useful for the high-speed processing of blocks. They produce a rock-face finish on the blocks. No two faces resulting from this process are identical, so the blocks are more natural in appearance than standard, non-split blocks. However, the edges of the faces resulting from the industry-standard splitting process are generally well-defined, i.e., regular and "sharp", and the non-split surfaces of the blocks, which are sometimes in view in landscape applications, are regular, "shiny" and non-textured, and have a "machine-made" appearance.

These concrete masonry blocks can be made to look more natural if the regular, sharp edges of their faces are eliminated.

One known process for eliminating the regular, sharp edges on concrete blocks is the process known as tumbling. In this process, a relatively large number of blocks are loaded into a drum which is rotated around a generally horizontal axis. The blocks bang against each other, knocking off the sharp edges, and also chipping and scarring the edges and faces of the blocks. The process has been commonly used to produce a weathered, "used" look to concrete paving stones. These paving stones are typically relatively small blocks of concrete. A common size is 3:inches wide by 7:inches long by 2 2 inches thick, with a weight of about 6 pounds.

The tumbling process is also now being used with some retaining wall blocks to produce a weathered, less uniform look to the faces of the blocks. There are several drawbacks to the use of the tumbling process in general, and to the tumbling of retaining wall blocks, in particular. In general, tumbling is a costly process. The blocks must be very strong before they can be tumbled. Typically, the blocks must sit for several weeks after they have been formed to gain adequate strength. This means they must be assembled into cubes, typically on wooden pallets, and transported away from the production line for the necessary storage time. They must then be transported to the tumbler, depalletized, processed through the tumbler, and recubed and repalletized. All of this "off-line" processing is expensive. Additionally, there can be substantial spoilage of blocks that break apart in the tumbler. The tumbling apparatus itself can be quite expensive, and a high maintenance item.

Retaining wall blocks, unlike pavers, can have relatively complex shapes. They are stacked into courses in use, with each course setback a uniform distance from the course below. Retaining walls must also typically have some shear strength between courses, to resist earth pressures behind the wall. A common way to provide uniform setback and course-to-course shear strength is to form an integral locator/shear key on the blocks. Commonly these keys take the form of lips (flanges) or tongue and groove structures. Because retaining wall blocks range in size from quite small blocks (e.g. about 10 pounds and having a front face with an area of about 3 square foot) up to quite large blocks having a front face of a full square foot and weighing on the order of one hundred pounds, they may also be cored, or have extended tail sections. These complex shapes cannot survive the tumbling process. Locators get knocked off, and face shells get cracked through. As a consequence, the retaining wall blocks that do get tumbled are typically of very simple shapes, are relatively small, and do not have integral locator/shear keys. Instead, they must be used with ancillary pins, clips, or other devices to establish setback and shear resistance. Use of these ancillary pins or clips makes it more difficult and expensive to construct walls than is the case with blocks having integral locators.

Another option for eliminating the sharp, regular edges and for distressing the face of concrete blocks is to use a hammermill-type machine. In this type of machine, rotating hammers or other tools attack the face of the block to chip away pieces of it. These types of machines are typically expensive, and require space on the production line that is often not available in block plants, especially older plants. This option can also slow down production, if it is done "in line", because the process can only move as fast as the hammermill can operate on each block, and the blocks typically need to be manipulated, e.g. flipped over and/or rotated, to attack all of their edges. If the hammermill-type process is done off-line, it creates many of the inefficiencies described above with respect to tumbling.

Accordingly, there is a need for equipment and a process that creates a more natural appearance to the faces of concrete retaining wall blocks, by, among other things, eliminating the regular, sharp face edges that result from the industry-standard splitting process, particularly, in such a manner that it does not slow down the production line, does not add costly equipment to the line, does not require additional space on a production line, is not labor-intensive, and does not have high cull rates when processing blocks with integral locator flanges or other similar features.

SUMMARY OF THE INVENTION

In accordance with a first aspect of the invention, there is provided a masonry block with a block body that includes a top surface, a bottom surface, a front surface extending between the top and bottom surfaces, a rear surface extending between the top and bottom surfaces, and side surfaces between the front and rear surfaces. A locator protrusion is disposed on either the top or the bottom surface (preferably, the bottom surface). Further, the intersection of the front surface and the top surface define an upper edge, and the intersection of the front surface and the bottom surface defining a lower edge, and the front surface has been given a rock-like texture, and at least one of the upper edge and the lower edge are roughened (that is, distressed so as to not appear as sharp with well-defined, regular edges, but, rather, to appear to have been weathered, tumbled, or otherwise broken, irregular and worn).

In accordance with a second aspect of the invention, there is provided a wall that is formed from a plurality of the masonry blocks.

In accordance with another aspect of the invention, there is provided a masonry block formed from a molded workpiece. The masonry block comprises a block body that includes a top surface, a bottom surface, a roughened front surface extending between the top and bottom surfaces, a rear surface extending between the top and bottom surfaces, and side surfaces between the front and rear surfaces, wherein a portion of at least two of the surfaces is textured as a result of the action of the workpiece-forming mold.

In another aspect of the invention, a masonry block is provided that is produced from a molded workpiece that is split in a block splitter having a splitting line, the block splitter comprising a first splitting assembly that includes a plurality of projections disposed on at least one side of the splitting line. The projections are positioned so that they engage the workpiece during the splitting operation, whereby the masonry block includes at least one irregular split edge and surface produced by the first splitting assembly.

In accordance with another aspect of the invention, a method of producing a masonry block having at least one irregular split edge and surface is provided. The method comprises providing a masonry block splitter having a splitting line with which a masonry workpiece to be split is to be aligned, with the block splitter including a first splitting assembly that includes a plurality of projections disposed on at least one side of the splitting line. The projections are positioned so that they engage the workpiece during the splitting operation. A masonry workpiece is located in the masonry block splitter so that the workpiece is aligned with the splitting line, and the workpiece is split into at least two pieces using the splitting assembly.

In another aspect of the invention, a masonry block is provided that is produced from a molded workpiece that is split in a block splitter having a first splitting blade with a cutting edge and blade surfaces extending away from the cutting edge at acute angles and which are engageable with the workpiece during the splitting operation, whereby the masonry block includes at least one irregular split edge and surface produced by the first splitting blade.

In still another aspect of the invention, a splitting assembly for use in a block splitter is provided that comprises a splitting blade, and a plurality of projections mounted on the splitting blade on at least one side thereof. The projections and the blade are fixed relative to each other during a splitting operation to split a workpiece whereby the projections and the blade move simultaneously during the splitting operation.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

Figure 1:
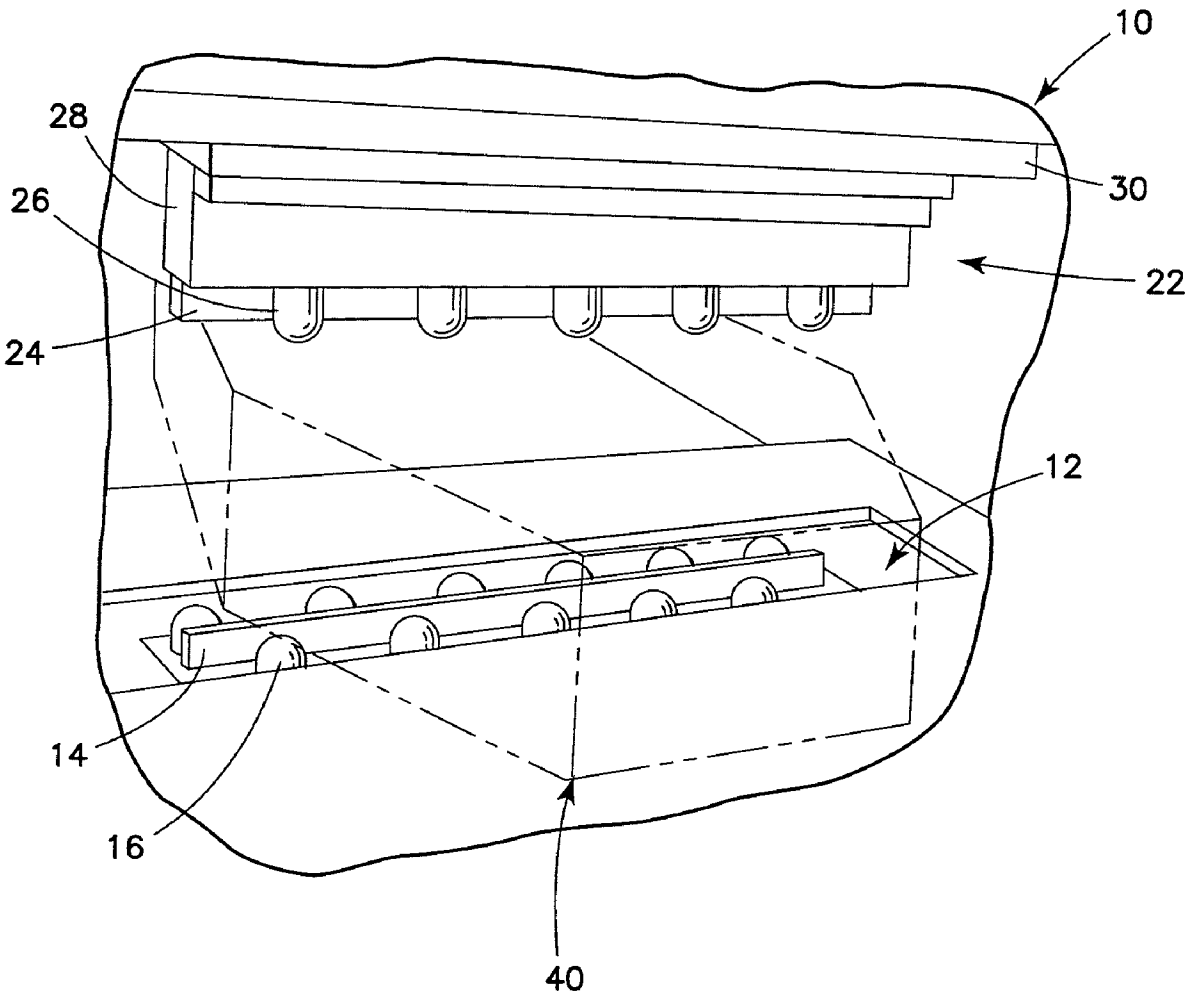
FIG. 1 is a partial perspective view of a block splitting machine using the block splitter blade assembly of the invention.

Attention is now directed to the figures where like parts are identified with like numerals through several views. In FIG. 1, a conventional block splitting machine modified in accordance with the invention is depicted, in part, showing in particular the block splitter assembly 10. Generally, block splitting machines suitable for practicing the present invention may be obtained from Lithibar Co., located in Holland, Mich. and other equipment manufacturers. In particular, the Lithibar Co. model 6386 was used in practicing the invention. The block splitter assembly 10 generally comprises a support table 11, and opposed first 12 and second 22 splitting blade assemblies. The first splitting blade assembly 12 is positioned at the bottom of the block splitter 10 and, as depicted, includes a splitting blade 14 and a number of projections positioned on either side of and adjacent to the blade. In this case, the projections 16 are generally cylindrically-shaped pieces of steel, having rounded or bullet-shaped distal ends. The first splitting blade assembly 12 is adapted to move upwardly through an opening in the support table 11 to engage the workpiece 40, and to move downwardly through the opening so that a subsequent workpiece can be positioned in the splitter.

The invention may be used with any variety of blocks molded or formed through any variety of processes including those blocks and processes disclosed in U.S. Pat. No. 5,827,015 issued Oct. 27, 1998, U.S. Pat. No. 5,017,049 issued May 21, 1991 and U.S. Pat. No. 5,709,062 issued Jan. 20, 1998.

An upper or second splitting blade assembly 22 may also be seen in FIG. 1. The second splitting blade assembly 22 also includes a splitting blade 24 and a plurality of projections 26 located on either side of the blade 24. The second splitting blade assembly may be attached to the machine's top plate 30 through a blade holder 28. The position of the workpiece 40, (shown in phantom), within the block splitter may be seen in FIG. 1, in the ready-to-split position.

Figure 2B:
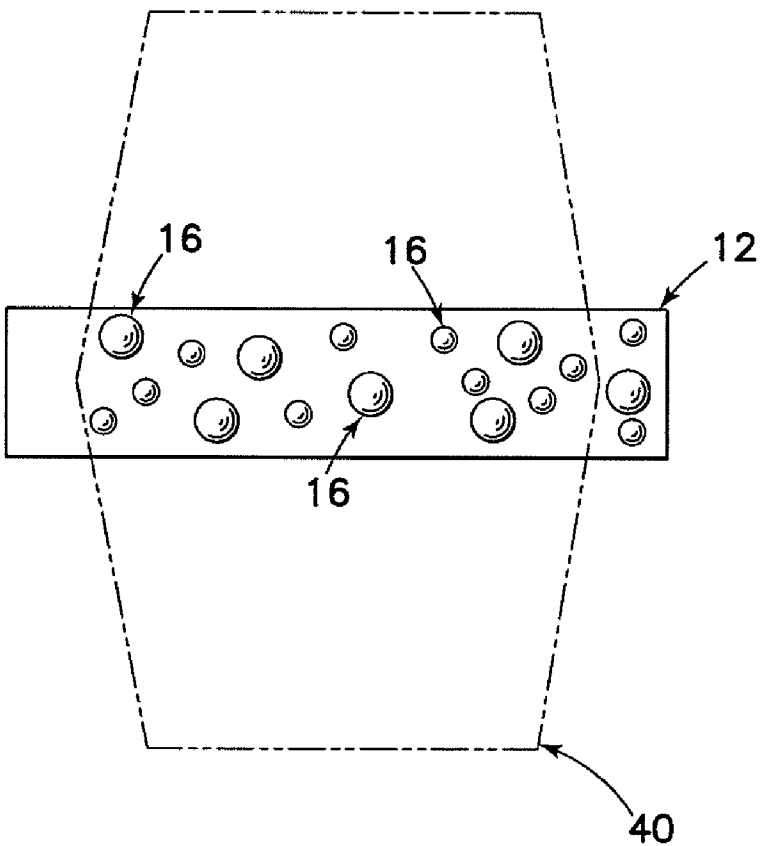
FIG. 2B is a top plan view of one portion of a splitting blade assembly also showing projections of various diameters positioned in a random manner.
Figure 2A:
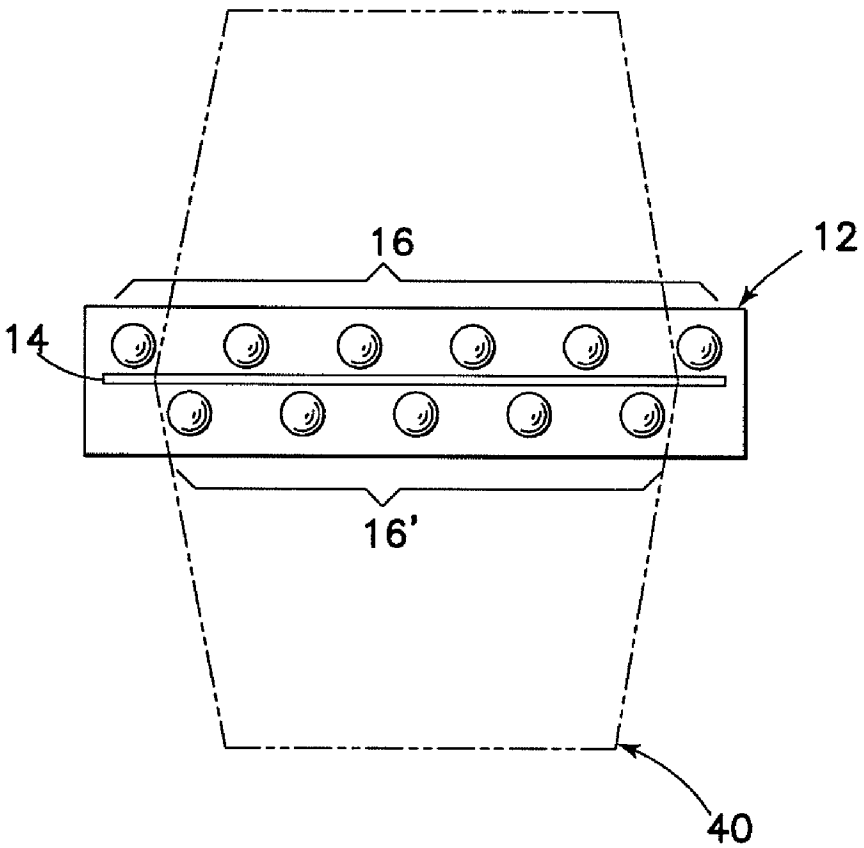
FIG. 2A is a top plan view of one portion of a splitting blade assembly in accordance with the invention.

As can be seen in FIG. 2A, the splitting blade assembly 12 is generally comprised of a number of projections 16 positioned adjacent to the blade 14 and on either side of the blade 14. As shown, the projections 16 on the first side of the blade are staggered in relationship to the projections 16' on the second side of the blade. The projections on either side of the blade may also be aligned depending upon the intent of the operator.

As can be seen in FIG. 2B, the projections 16 may be used without a splitting blade. The projections 16 may also be varied in diameter or perimeter, (if not round), and placed randomly on the splitting assembly 12. Any number of ordered or random patterns of projections 16 may be created using regular or irregular spacing depending on the effect to be created in the split block.

Figure 2C:
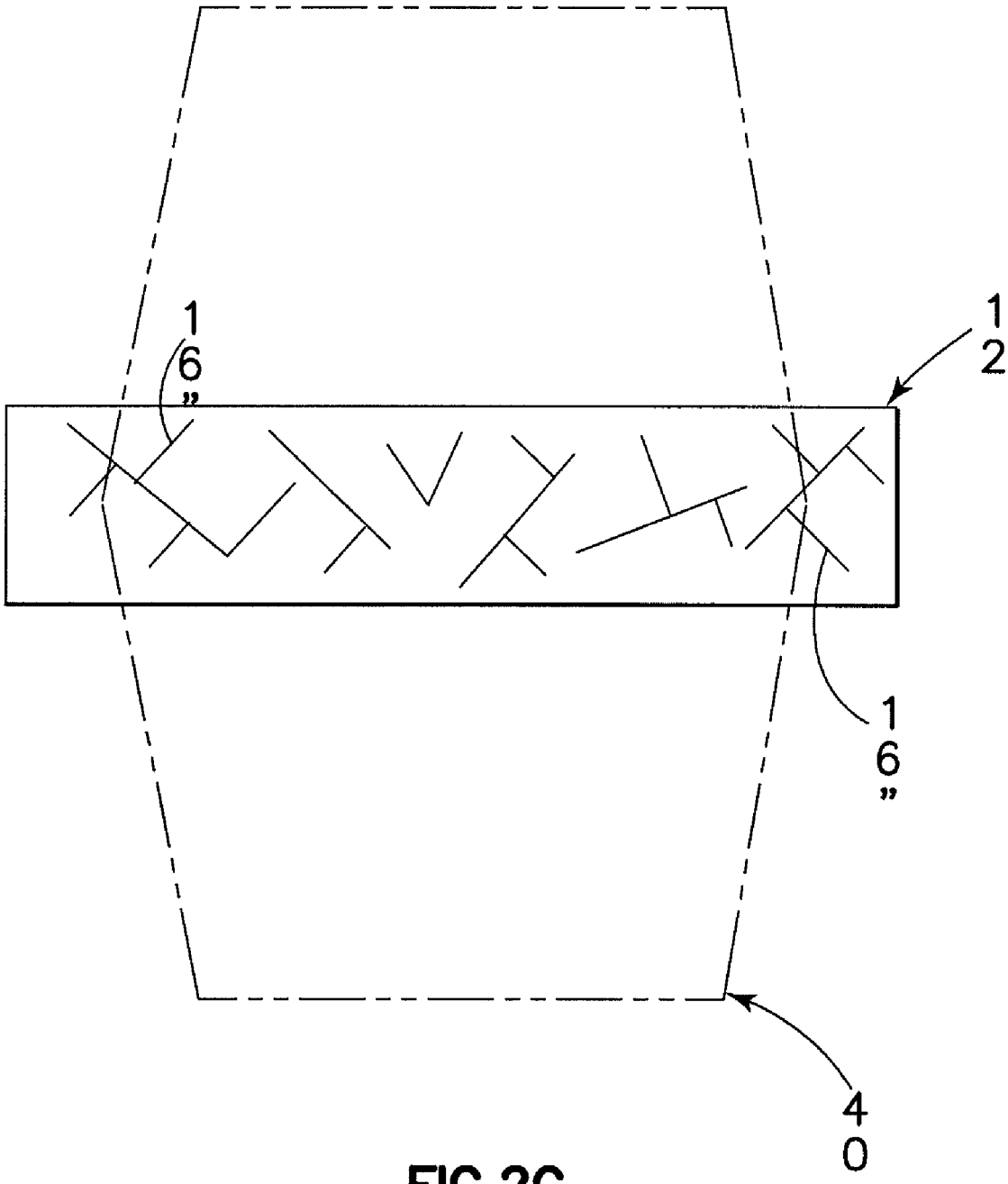
FIG. 2C is a top plan view of one portion of a splitting blade assembly in accordance with a further alternative embodiment of the invention comprising projections which are random connected and unconnected panels.

FIG. 2C shows a further alternative embodiment of the invention where plates 16" are attached to either, or both, assemblies 12 and 22. As can be seen, these plates may be configured in random order and left unconnected across the surface of the assembly 12. The invention has been practiced using steel plates about four inches long welded to the assembly to provide a number of partially connected projections 16" about two inches high.

In splitting assemblies in which splitting blades are used, such as the splitting blades 14, 24, the splitting blades are arranged in coplanar relationship, and so as to engage the bottom and top surfaces of the workpiece 40 in a generally perpendicular relationship. The splitting blade 14 (and likewise the splitting blade 24) define a splitting line SL, shown in FIG. 2A, with which the workpiece 40 is aligned for splitting. When splitting blades are not used, such as shown in FIG. 2B, the workpiece 40 is still aligned with the splitting line SL which is illustrated as extending generally through the center of the assembly 12. In either event, block splitters conventionally have a splitting line SL, defined by splitting blades when used, with which the workpiece is aligned for splitting.

As shown in FIGS. 1, 2A and 2B, the projections 16 and 16' may have a rounded shape. However, the shape of the projections may also be pyramidal, cubic, or pointed with one or more points on the top surface of the projection. In FIGS. 2A, 2B and 2C, the relative position of the workpiece 40 is shown again in phantom outline.

Generally, the projections may have a diameter of about 2 to about 1 3 inches and may be attached to the blade assembly by welding, screwing or other suitable means. The height of the projections may be about 1 3 inches and varied about: of an inch shorter or taller depending upon the affect to be created in the block at splitting. Attaching the protrusions by threading or screwing, see FIGS. 8-9 and 11, allows easy adjustment of projection height.

Figure 3:
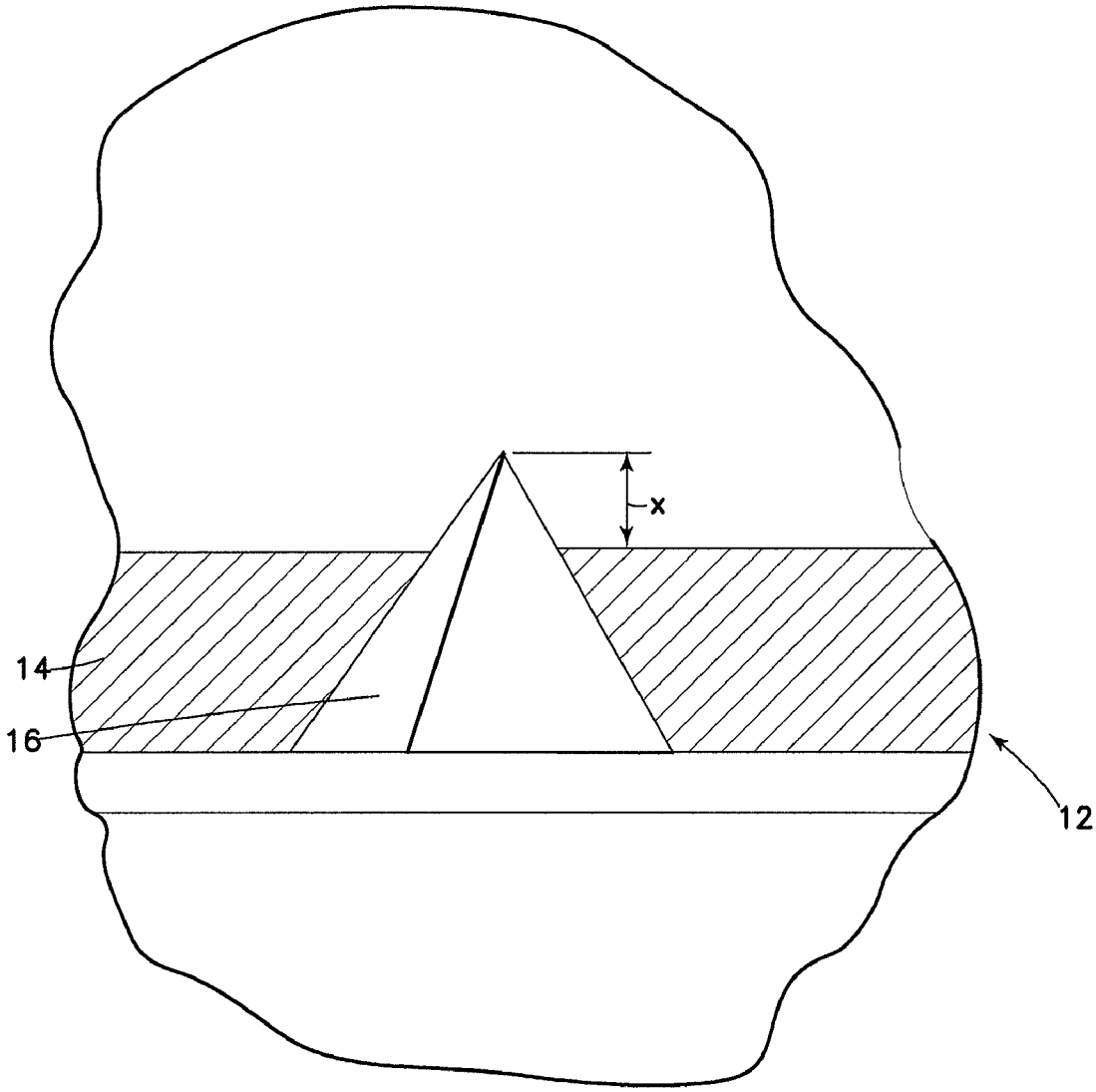
FIG. 3 is a side elevational view of an alternative embodiment of a projection in accordance with the invention.
Figure 4A:
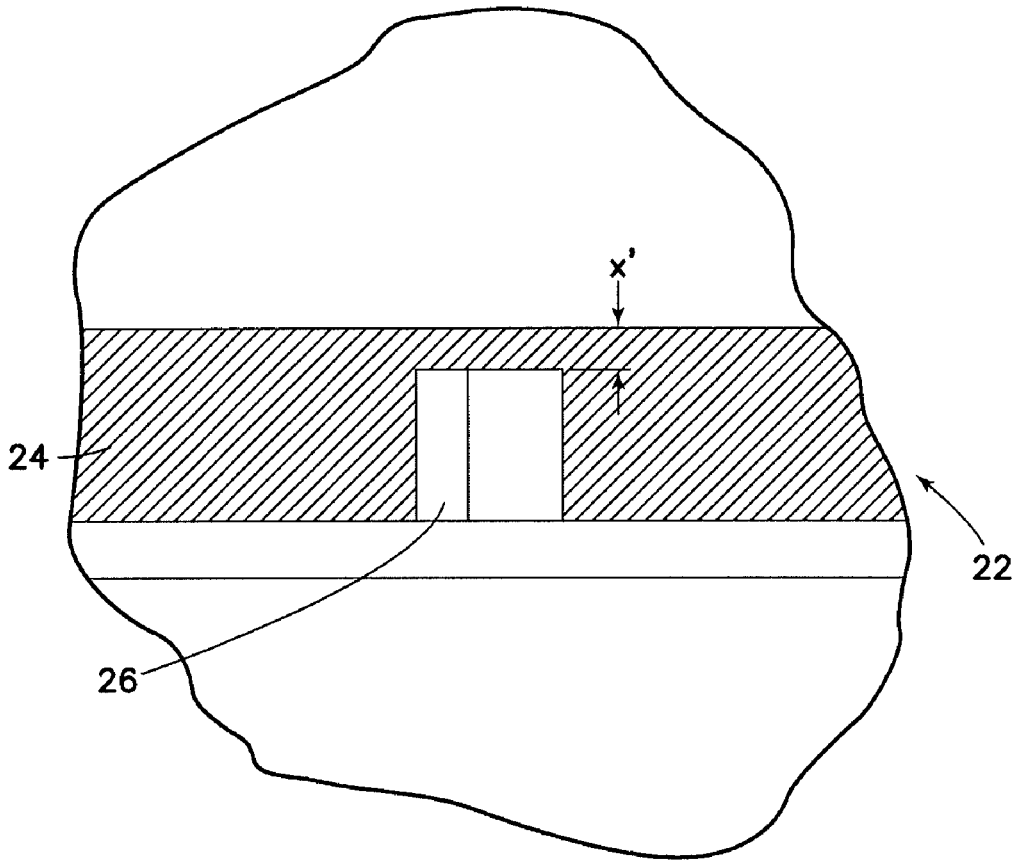
FIG. 4A is a side elevational view of a further alternative embodiment of a projection in accordance with the invention.
Figure 4B:
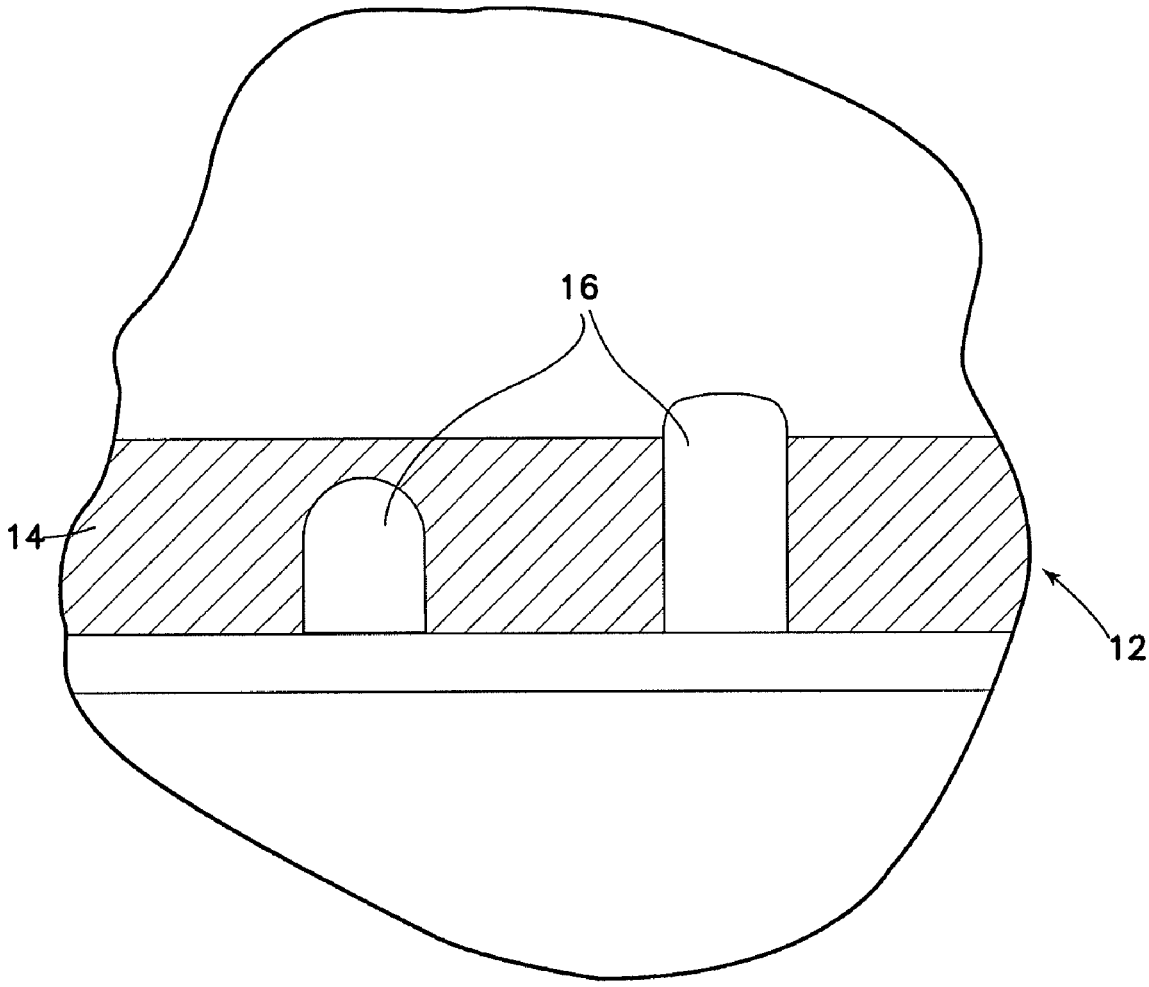
FIG. 4B is a side elevational view of another alternative embodiment of the invention depicting projections of varying heights.

The relative height of the projection and blade may also be varied depending upon the effect that is to be created in the block that is split from a workpiece according to the invention. Specifically, as can be seen in FIG. 3 the relative height of the blade 14 may be less than the relative height of the projection 16. Alternatively, as can be seen in FIG. 4A the relative height of the blade 24 may be greater than the height of the projections 26. For example, we have found with the first splitting blade assembly 12 that X may range from about ⅛ to about ⅜ of an inch below or beyond the first blade 14. With regard to the second splitting blade assembly 22, X' may range from about 1/16 to about 1/8 of an inch beyond the height of the plurality of the projections 26.

Projections 16 such as those depicted in FIG. 2A have been found useful having a diameter of about 1 and 1/4 inches and, when used with a blade 14, having a height of about 1/8 of an inch below the blade in the first or lower assembly 12 and about 1/8 of an inch below the blade 24 in the second or upper assembly 22. Overall, the height of the projections on either the lower assembly 12 or upper assembly 22 may vary up or down as much as about 3/8 of an inch relative to the height of the blade in either direction relative to the top of the blade, with the top of the blade being zero.

Figure 5:
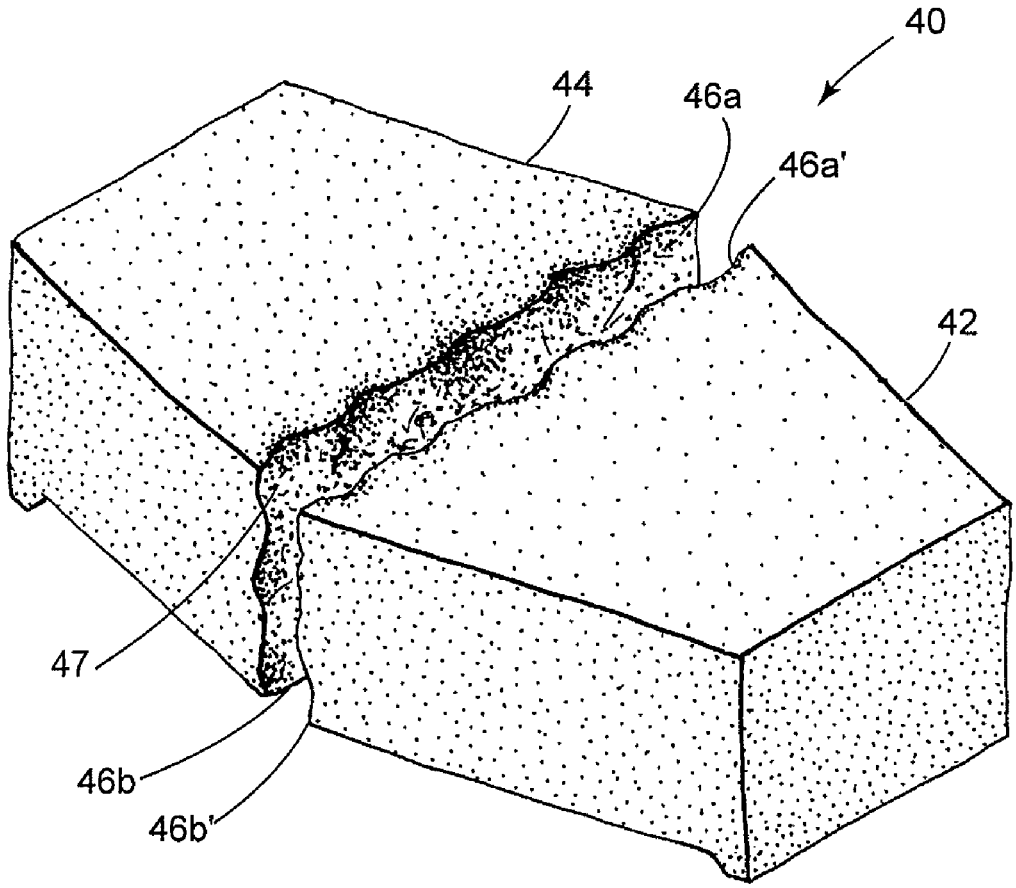
FIG. 5 is a perspective view of a split workpiece (forming two masonry blocks), which was split using the splitter blade assembly of the invention.

In operation, the workpiece 40 is generally centered in the block splitter and aligned with the splitting line SL according to known practices as seen in FIGS. 1 and 2A, B and C. The block splitter is then activated resulting in the first and second opposing splitting blade assemblies 12, 22 converging on, and striking, the workpiece 40. In operation, the first and second splitting blade assemblies may travel anywhere from about 1/4 to about one inch into the top and bottom surfaces of the workpiece. The workpiece 40 is then split resulting in an uneven patterning on the split edges 46*a*, 46*b* and 46*a*', 46*b*' of the respective resulting blocks 42 and 44, as illustrated in FIG. 5. As depicted, the workpiece 40 is split in two. However, it is possible and within the scope of the invention to split the workpiece into more than two pieces. It is also possible and within the scope of the invention to split the workpiece into a usable masonry block and a waste piece.

The distance traveled by the projections 16, 26 into the workpiece may be varied by adjusting the limit switches on the block splitting machine and, in turn, varying the hydraulic pressure with which the splitting assemblies act. Generally, the splitting assemblies act on the block with a pressure ranging from about 600 to about 1000 psi, and preferably about 750 to about 800 psi.

As will be well understood by one of skill in the art, the splitting machine may include opposed hydraulically activated side knife assemblies (not shown) which impinge upon the block with the same timing and in the same manner as the opposed top and bottom assemblies. Projections 16, 26 may also be used to supplement or replace the action of the side knives, as discussed below with respect to FIG. 12. For example, side knives similar to the upper splitting blade 24 shown in FIG. 8 can be employed.

Figure 6:
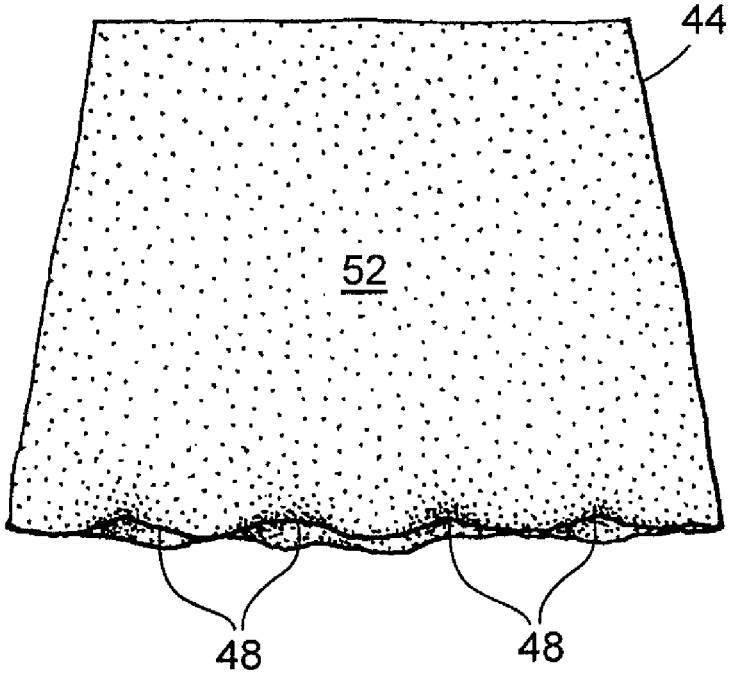
FIG. 6 is a top plan view of a masonry block split using the splitter blade assembly of the invention.
Figure 7:
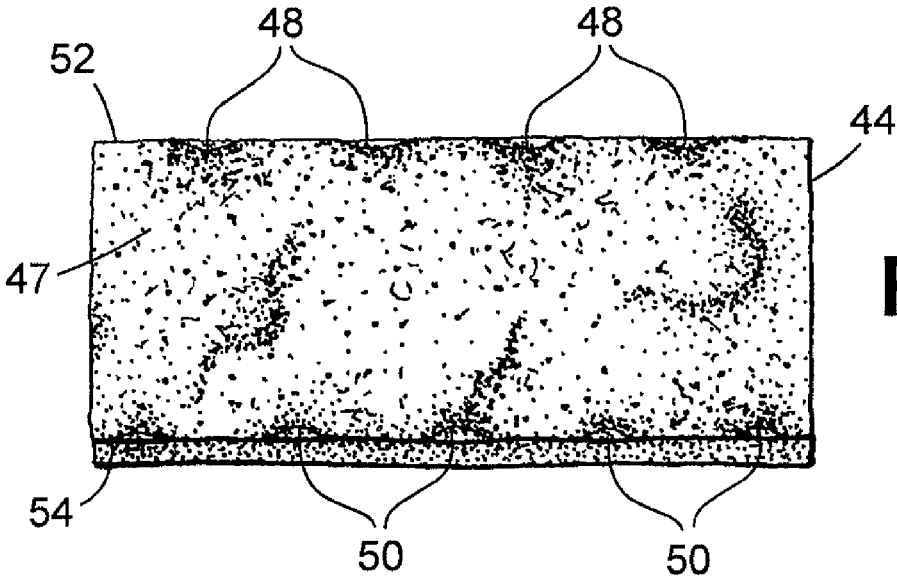
FIG. 7 is a front elevational view of the masonry block depicted in FIG. 6.

Closer examination of block 44 after splitting (see FIGS. 6 and 7) shows the formation of exaggerated points of erosion in the front, split surface 47 of the block 44. With the block 44 depicted, both the first and second blade assemblies 12 and 22 comprised projections 16 and 26, respectively. As a result, depressions 48 and 50 were formed at the upper and lower edges 46*a*, 46*b* of the front, split surface 47 of the block 44, at the intersection with the upper 52 and lower 54 respective surfaces of the block 44.

The magnitude of the indentations, 48 and 50, or points of erosion is far greater than that which is caused by conventional splitting blades and may be varied by varying the prominence of the projections 16 and 26, (height and size), relative to the height and thickness of the blade. In one embodiment of the invention, masonry block may be split with only a row or rows of projections 16 and 26 without a blade 14 and 24.

Figure 8:
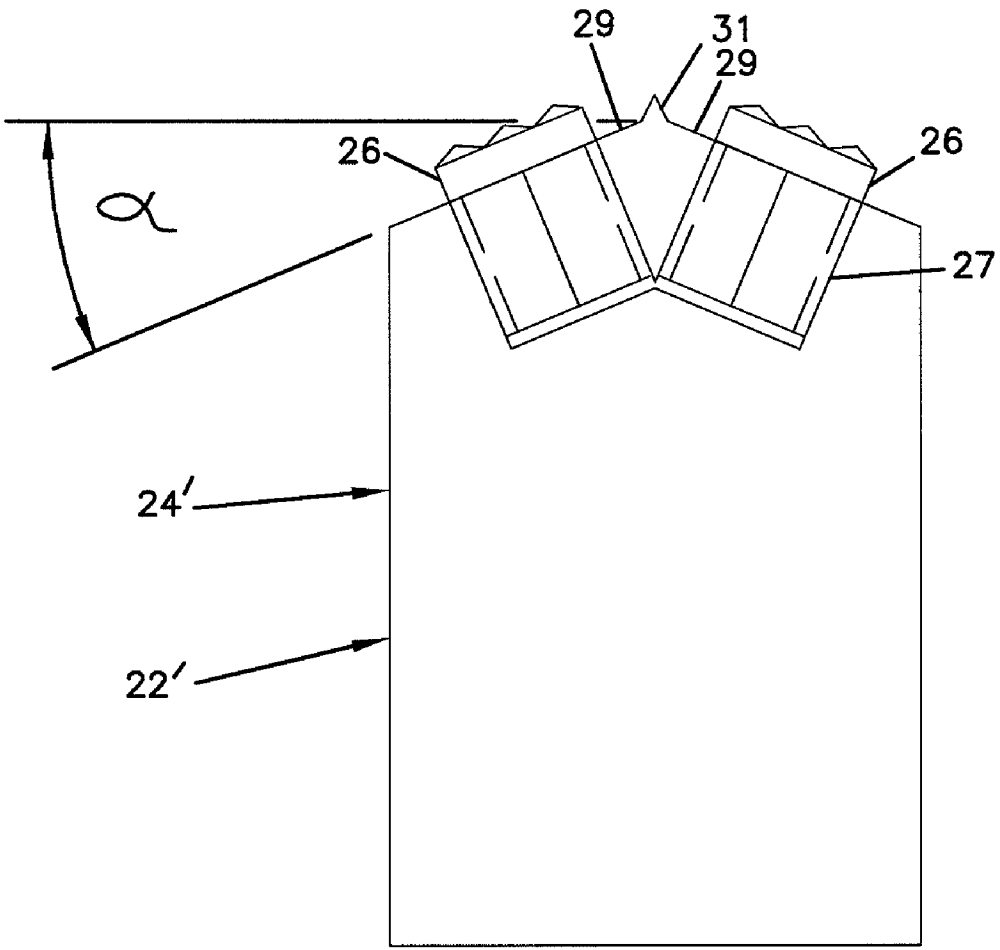
FIG. 8 is a partially sectioned end view of an alternative embodiment of a top splitter blade assembly.
Figure 9:
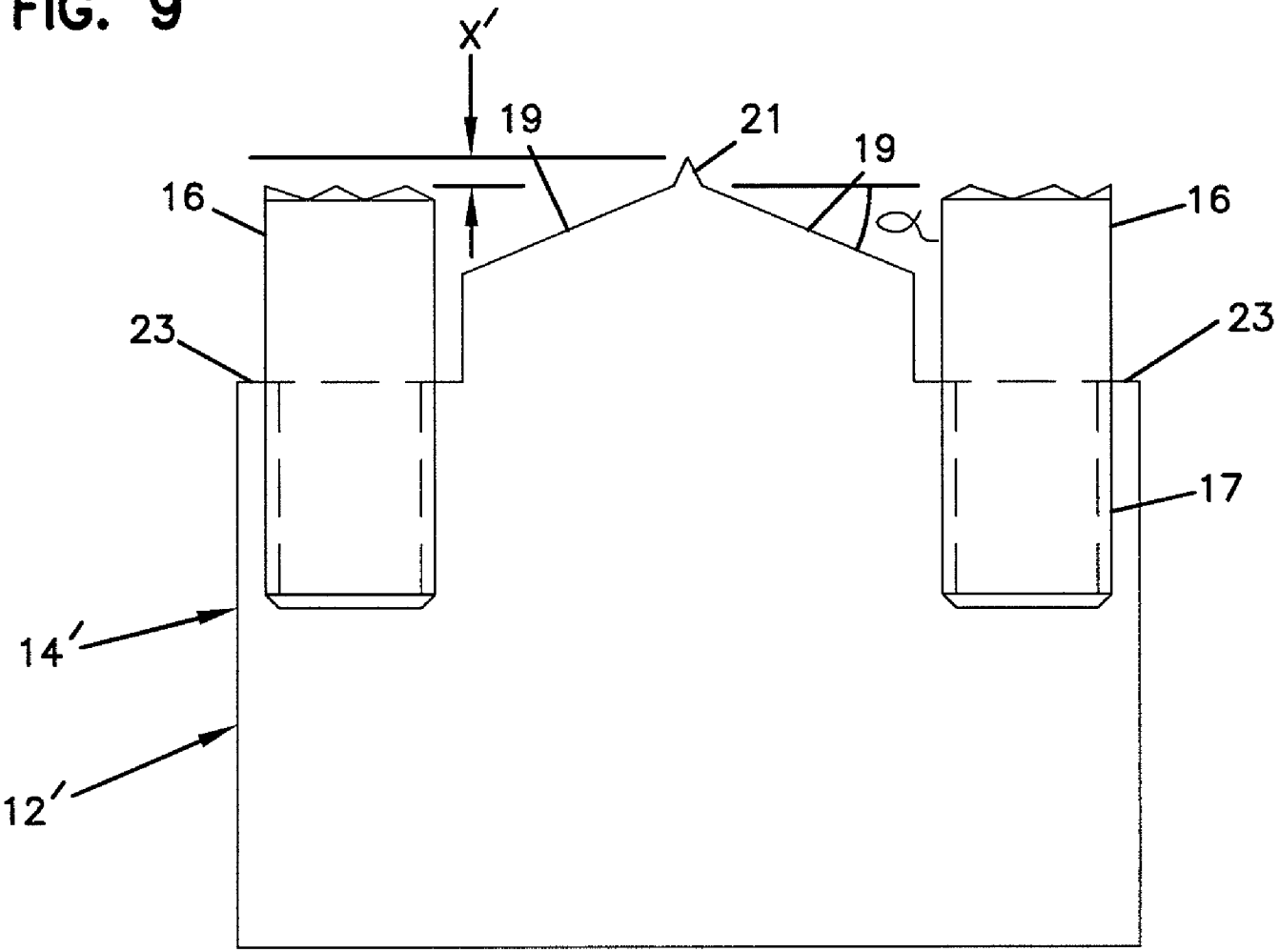
FIG. 9 is a partially sectioned end view of an alternative embodiment of a bottom splitter blade assembly.

Referring to FIGS. 8 and 9, alternative embodiments of a top splitting blade assembly 22' and bottom splitting blade assembly 12', respectively, are shown. It has been found that more massive blades 14', 24' having projections 16, 26 thereon create a more desirable block face appearance. Blades 14', 24' include a central cutting edge 21, 31, respectively, and surfaces 19, 29 extending outwardly therefrom. The tip of each cutting edge 21, 31 defines the splitting line along which the workpiece will be split. Surfaces 19, 29 extend away from the cutting edges 21, 31 at relatively shallow angles, so that, as the blade assemblies converge during splitting, the surfaces 19, 29 will engage the split edges of the workpiece. This engagement breaks, chips, distresses, or softens the split edges in an irregular fashion, and the distressing action can be enhanced by placing projections on the surfaces 19, 29, as desired. The surfaces 19, 29 are preferably at an angle $\alpha$ between about 0° and about 30° relative to horizontal, most preferably about 23°.

Blades 14', 24' include projections 16, 26 that are adjustable and removable. In this way, the same blade assembly can be used for splitting different block configurations by changing the number, location, spacing and height of the projections. Projections 16, 26 are preferably threaded into corresponding threaded openings 17, 27 for adjustment, although other height adjustment means could be employed. However, during a splitting action, the projections and the blades are in a fixed relationship relative to each other, whereby as the blade moves, the projections associated with the blade move simultaneously with the blade.

The projections 16, 26 in this embodiment are preferably made of a carbide tipped metal material. In addition, the top surface of the projections 16, 26 is jagged, comprising many pyramids in a checkerboard pattern. Projections such as these can be obtained from Fairlane Products Co. of Fraser, Mich. It will be understood that a variety of other projection top surface configurations could be employed. The height of the top surface of the projections is preferably a distance X' below the tip of cutting edge 21, 31, most preferably 0.040 inch below. As discussed above with respect to other embodiments, the projections may extend further below, or some distance above, the top of the blade, within the principles of the invention. The projections shown are about 3/4 inch diameter with a 10 thread/inch pitch, and are about 1.50 inches long. Diameters between about 0.50 and about 1.0 inch are believed preferable. The loose block material from the splitting process entering the threads, in combination with the vertical force of the splitting strikes, are considered sufficient to lock the projections in place. However, other mechanisms could be used to lock the projections in place relative to the blades during the splitting process.

As should be apparent from the description, the cutting edges 21, 31 and the projections 16, 26 are wear locations during the splitting process. The removable mounting of the projections 16, 26 permits the projections to be removed and replaced as needed due to such wear. It is also preferred that the cutting edges 21, 31 be removable and replaceable, so that as the cutting edges 21, 31 wear, they can be replaced as needed. The cutting edges 21, 31 can be secured to the respective blade 14', 24' through any number of conventional removable fastening techniques, such as by bolting the cutting edges to the blades, with the cutting edges 21, 31 being removably disposed within a slot 25 formed in the blade as shown in FIG. 11 for the blade 14'.

The preferred top blade assembly 22' is about 2.5 inches wide as measured between the side walls 24*a*, 24*b* of the blade 24'. The projections 26 extend perpendicularly from the blade surfaces 29 and therefore strike the working piece at an angle.

The preferred bottom blade assembly 12' is about 4.0 inches wide as measured between the side walls 14*a*, 14*b* of the blade 14'. The projections 16 extend upwardly from shoulders 23 on opposite sides of the blade surfaces 19. This configuration breaks away more material and creates a more rounded rock-like top edge of the resulting split block (the workpiece is typically inverted or "lips up" during splitting because the workpiece is formed in a "lips up" orientation that allows the workpiece to lay flat on what is to be the upper surface of the resulting block(s)).

Figure 11:
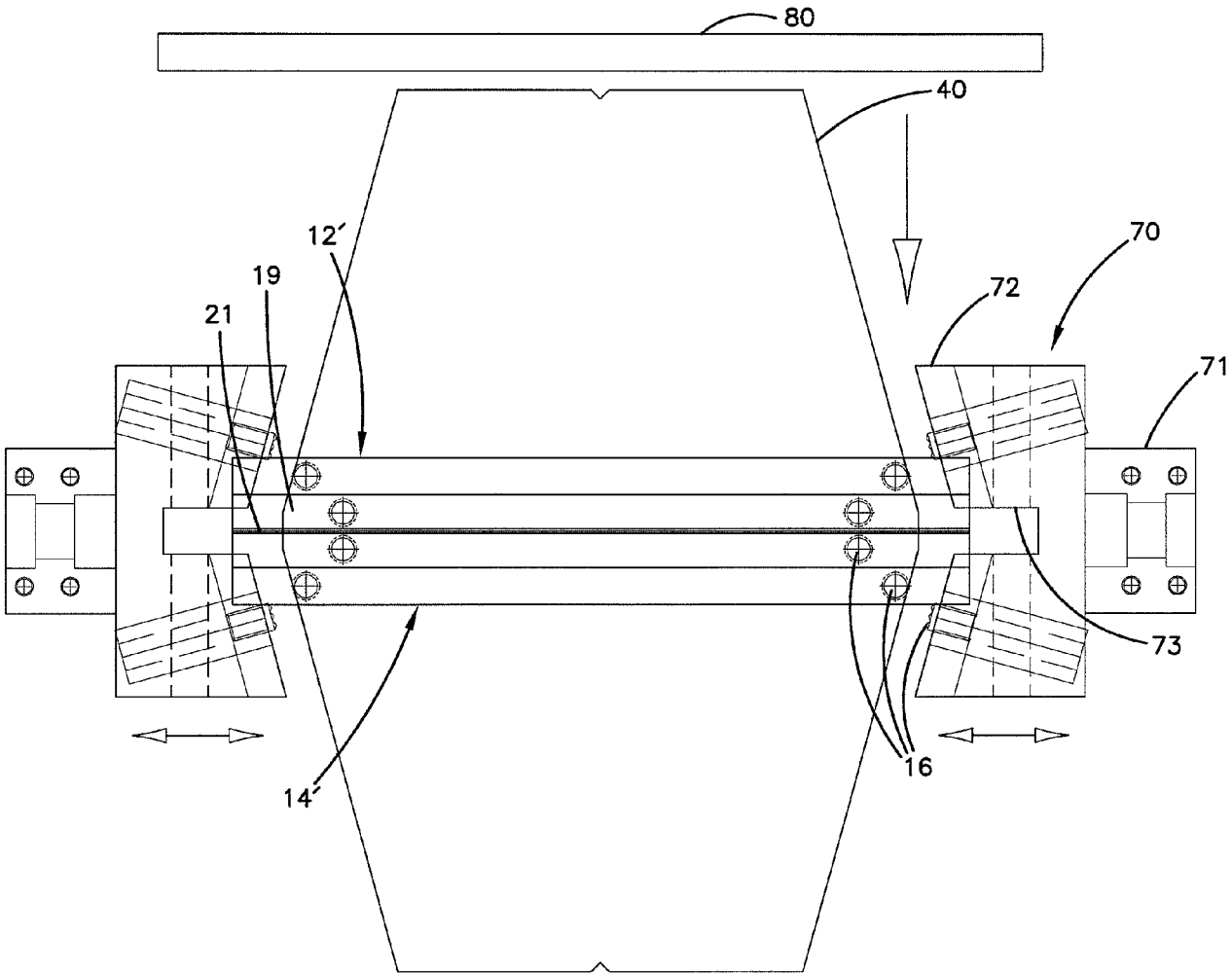
FIG. 11 is a partially sectioned end view of another alternative embodiment of a bottom splitter blade assembly.
Figure 12:
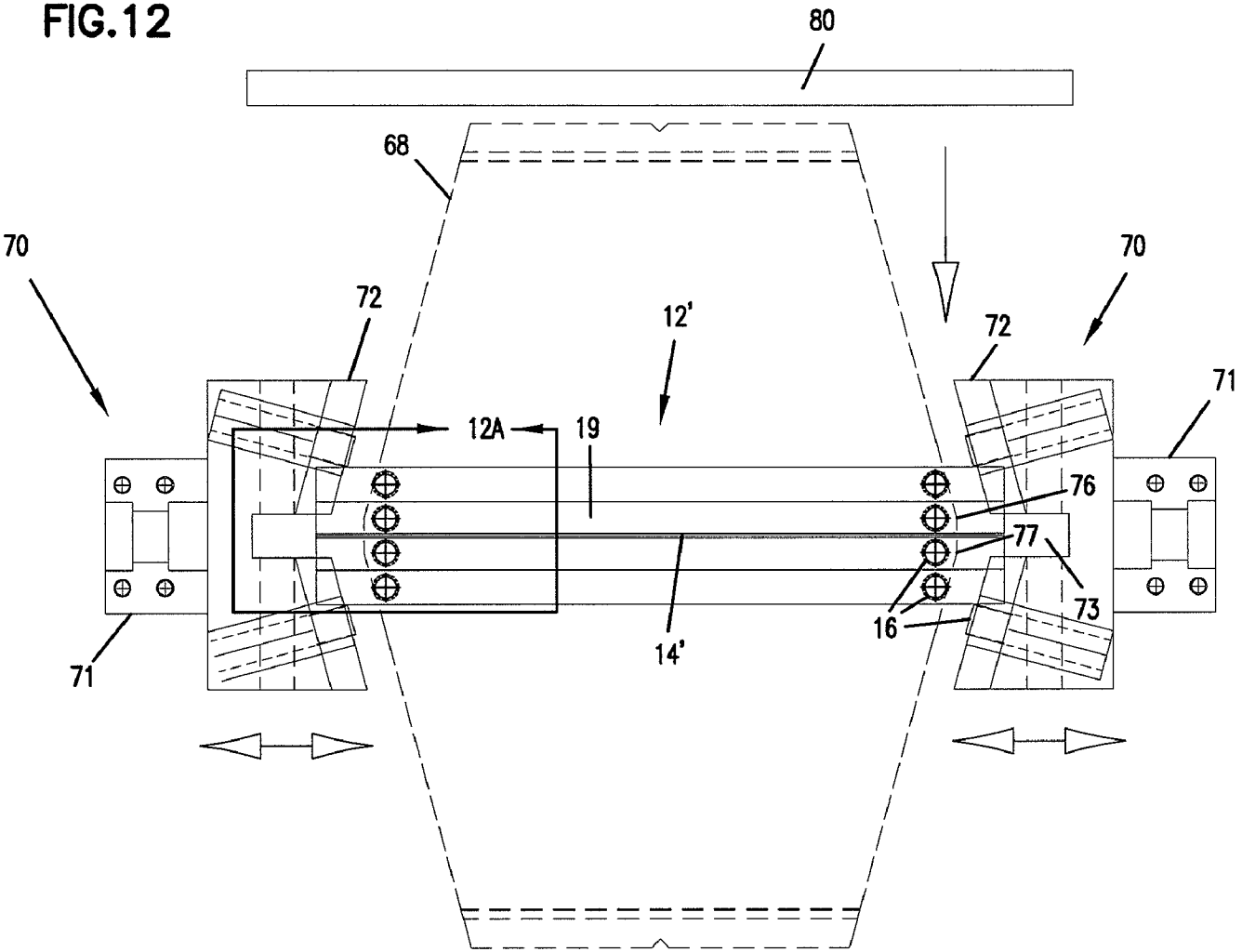
FIG. 12 is a top plan view of a gripper assembly according to the present invention and a portion of the bottom splitter blade assembly of FIG. 11 with another arrangement of projections, shown in relation to a workpiece.

The preferred bottom blade assembly 12' also includes adjustable and removable projections 16 extending upward from the blade surfaces 19, as shown in FIGS. 11 and 12. In this case, the projections 16 extend perpendicular to the surfaces 19 and strike the workpiece at an angle. The projections 16 extending upward from the surfaces 19 and the projections extending upward from the shoulders 23 can be of different sizes as shown in FIG. 11, or of the same size as shown in FIG. 12.

The angling of the projections 16 on the surfaces 19 of the blade 14', and the angling of the projections 26 on the surfaces 29 of the blade 24', allows the projections 16, 26 to gouge into the workpiece and break away material primarily adjacent the bottom and top edges of the resulting block, however without breaking away too much material. As described below in more detail with respect to FIG. 12, the bottom blade assembly typically contacts the workpiece after the top blade assembly has begun its splitting action. The initial splitting action of the top blade assembly can force the resulting split pieces of the workpiece away from each other before the bottom blade assembly 12' and the angled projections 16 can fully complete their splitting action. The vertical projections 16 on the surfaces 23 of the blade 14' help to hold the split pieces in place to enable the angled projections 16 to complete their splitting action. The vertical projections 16 also break away portions of the split pieces adjacent the bottom edges of the resulting block(s). Thus, the angled and vertical projections 16 on the bottom blade 14' function together to produce a rounded bottom edge on the resulting block, while the angled projections 26 on the blade 24' function to produce a rounded top edge on the resulting block.

In operation, the blade assemblies of FIGS. 8 and 11 are preferably used together to split a workpiece, using the same cutting depth and hydraulic pressures described above. It will be understood that the bottom blade assembly could be used on top, and the top blade assembly could be used on the bottom.

Figure 10:
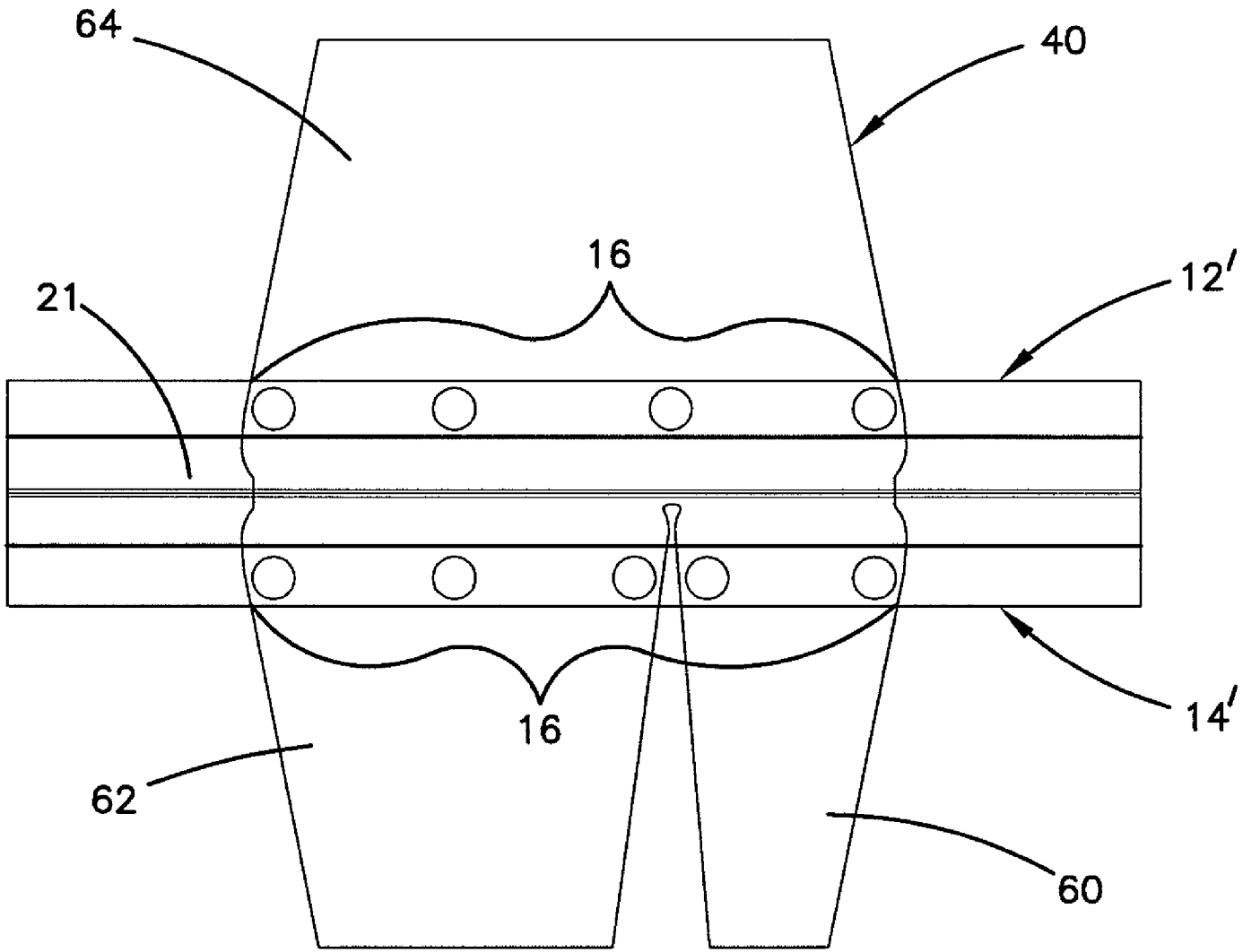
FIG. 10 is a top plan view of a portion of the bottom splitter blade assembly of FIG. 9 with one arrangement of projections, shown in relation to a workpiece.

Referring now to FIG. 10, a blade assembly according to FIG. 9 is depicted in position for striking a workpiece 58. The workpiece 58 comprises portions which will result in small 60, medium 62 and large 64 blocks. The projections 16 are preferably placed at appropriate locations on the blade 14' to create the three blocks 60, 62, 64 when the workpiece 58 is split. For example, the projections 16 can be located as shown in FIG. 10. The upper blade assembly of FIG. 8, which can be used in conjunction with the blade assembly of FIG. 9 to split the workpiece 58, has similarly oriented projections except that they are closer to the splitting line SL defined by the cutting edge 31. In this way, more rounded, rock-like edges on the resulting masonry blocks are formed in the splitting process.

The positioning of the projections on the blades 14', 24' can be used in conjunction with mold configurations that preform the workpiece 58 at pre-determined locations to better achieve rounded, rock-like corners. For example, the walls of the mold that are used to form the workpiece 58 in FIG. 10 can include suitable contoured portions so as to form the contoured regions 59*a*, 59*b*, 59*c* in the workpiece 58. The contoured regions 59*a*, 59*b*, 59*c* contribute to the formation of the rounded, rock-like corners when the workpiece 58 is split. Further information on the mold configuration that is used to create the workpiece 58 can be found in co-pending U.S. patent application Ser. No. 09/691,931, filed on Oct. 19, 2000, which is herein incorporated by reference in its entirety.

Figure 12A:
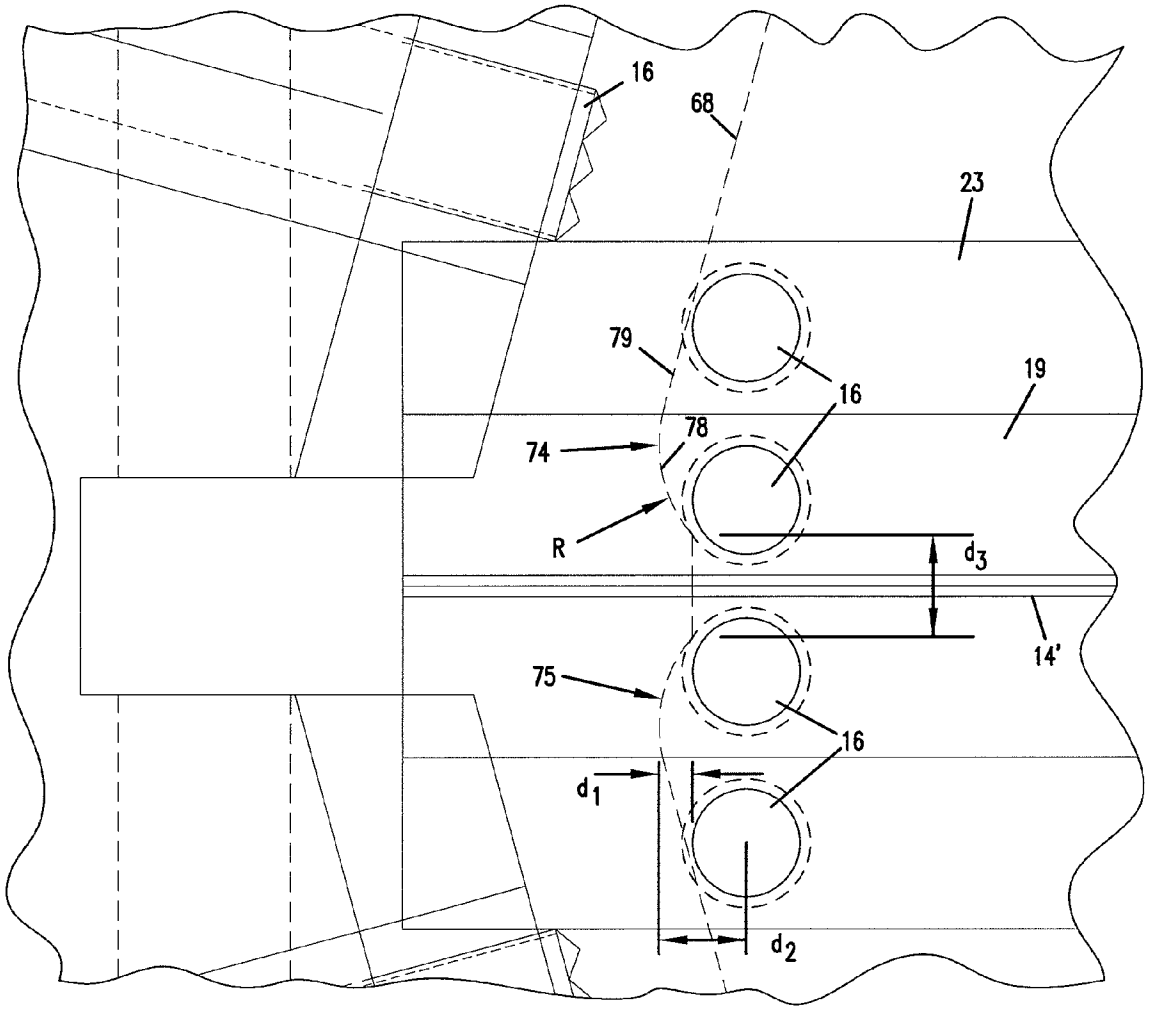
FIG. 12A is an exploded view of the portion contained within line 12A in FIG. 12.

Referring now to FIG. 12, a gripper assembly 70 is shown in conjunction with a preferred workpiece 68 for use in forming a pair of blocks according to the invention. A bottom splitting blade assembly 12' according to FIG. 11, which is preferably used in combination with the top splitting blade assembly of FIG. 8 to split the workpiece 68, is also shown in relation to the workpiece 68. FIG. 12A illustrates the portion contained within line 12A in FIG. 12 in greater detail. The workpiece 68 is illustrated in dashed lines for clarity.

Gripper assembly 70 is employed to assist with splitting certain types of larger block units. It is mounted via mounting head 71 on the existing side-knife cylinders of the splitting machine. Rubber shoes 72 are configured to conform to the corresponding outer surface of the workpiece 68. Each gripper assembly 70 moves in and out laterally, as indicated by arrows, in order to grip the workpiece 68 from both sides. In the preferred design, assembly 70 is about 3.0 inches high and rubber shoes 72 are 50-100 Durometer hardness. The pressure applied by the hydraulic cylinders is the same as that for the upper and lower blades.

One benefit of this gripper assembly is improving the formation of rounded edges of a workpiece made by a bottom splitting blade assembly. A workpiece 68 is moved along the manufacturing line by positioning bar 80 in the direction of the arrow shown. During splitting, while the rear portion of the workpiece 68 is held in place by the bar 80, the forward portion is free to move forward. Many splitting machines have a splitting action whereby the bottom blade assembly moves to engage the workpiece after the top blade assembly has touched the top of the workpiece. The initial cutting action of the top blade assembly can begin to move the forward portion forward before the bottom blade assembly has an opportunity to fully form a rounded edge on the forward block with for example projections 16 and/or blade surfaces 19. The bottom blade assembly can also lift the workpiece 68, which is undesirable for a number of reasons. By holding the workpiece 68 together during splitting, these problems are prevented.

Gripper assembly 70 can optionally include projections 16, as shown in FIGS. 12 and 12A. Projections 16 are preferably positioned slightly inside the top and bottom edges of the workpiece 68 (four projections for each gripper assembly 70) so when they strike the side of the workpiece 68, more rounded block corners will be formed. The assembly 70 can also include a side knife contained within its central cavity 73, having a blunt blade such as those described hereinabove, for forming rounded, rock-like side edges of the split blocks. It may be necessary to include an appropriate strength spring behind the side knife in order to get the desired action from the gripper and knife.

The preferred workpiece 68 is also formed to include contoured regions 74, 75, 76, 77 at pre-determined locations to better achieve rounded, rock-like corners. For example, the walls of the mold that are used to form the workpiece 68 in FIG. 12 can include suitable contouring so as to form the contoured regions 74-77 in the workpiece 68 (see FIG. 13). The contoured regions 74-77 contribute to the formation of the rounded, rock-like corners when the workpiece 68 is split. The contoured regions 74-77 preferably extend the entire height of the workpiece from the bottom surface to the top surface thereof.

The contoured regions 74, 75 are best seen in FIG. 12A. It is to be understood that the contoured regions 76, 77 are identical to the regions 74, 75 but located on the opposite side of the workpiece 68. The contoured regions each include a convex section 78 having a radius R and a linear section 79 that transitions into the side surface of the workpiece 68. The shape of the contoured regions is selected to achieve satisfactory radiused corners on the block once the workpiece 68 is split. Satisfactory results have been achieved using a radius R of about 1.0 inch, a distance $d_1$ between the intersection of the convex section 78 with the linear section 79 and the edge of the projection 16 of about 0.25 inches, a distance $d_2$ between the intersection of the convex section 78 with the linear section 79 and the center of the projection 16 of about 0.563 inches, and a distance $d_3$ between the closest points of the convex sections 74, 75 of about 0.677 inches. Other dimensions could be used depending upon the end results sought.

Figure 13:
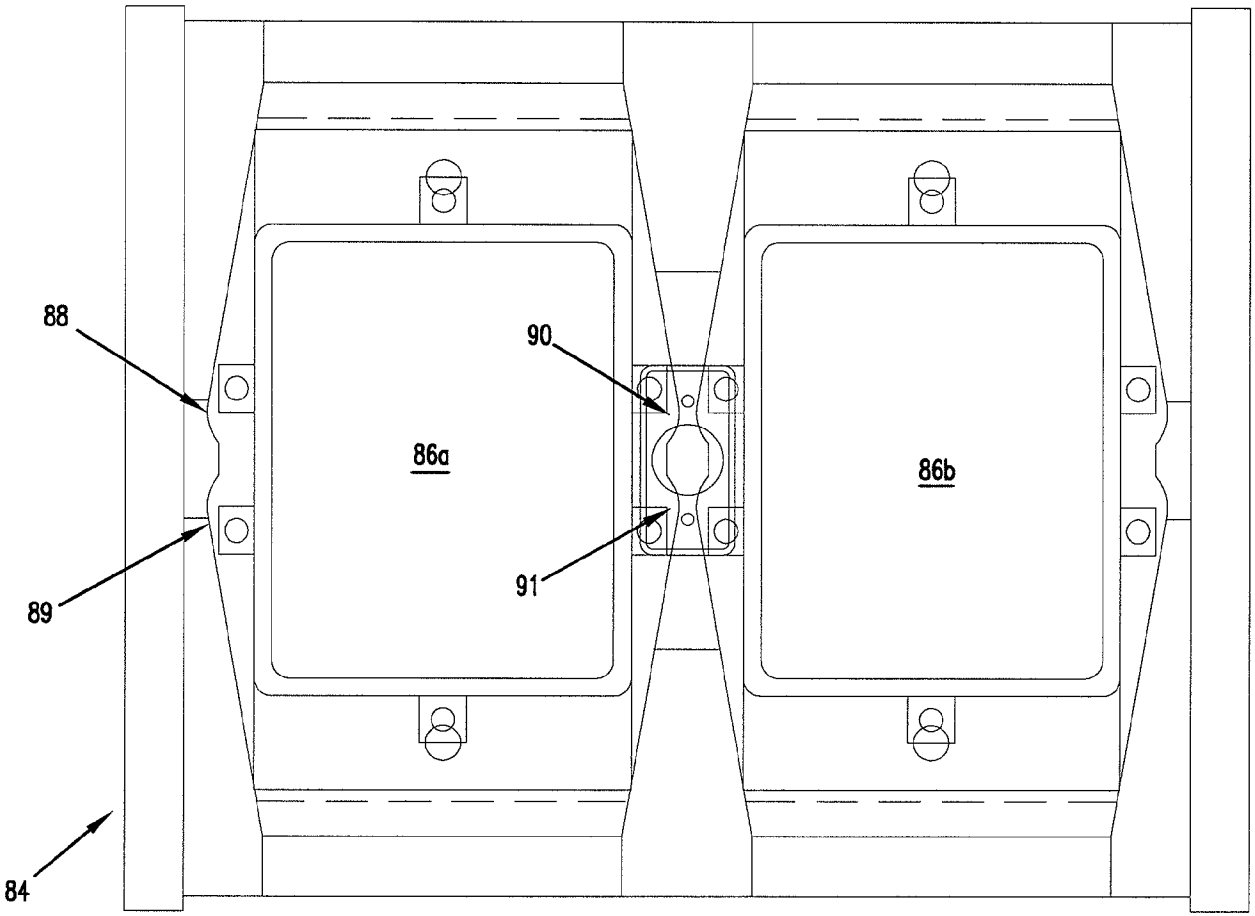
FIG. 13 is a top view of a mold assembly for forming the workpiece illustrated in FIG. 12.

FIG. 13 illustrates a mold 84 that is used to form the workpiece 68. The mold 84 is provided with two mold cavities 86*a*, 86*b* to permit simultaneous formation of a pair of workpieces 68 and ultimately four blocks. Other mold configurations producing a greater or smaller number of workpieces could be used as well. The walls of the mold 84 in each mold cavity include regions 88-91 that are shaped to produce the contoured regions 74-77, respectively, on the workpiece 68.

Figure 14:
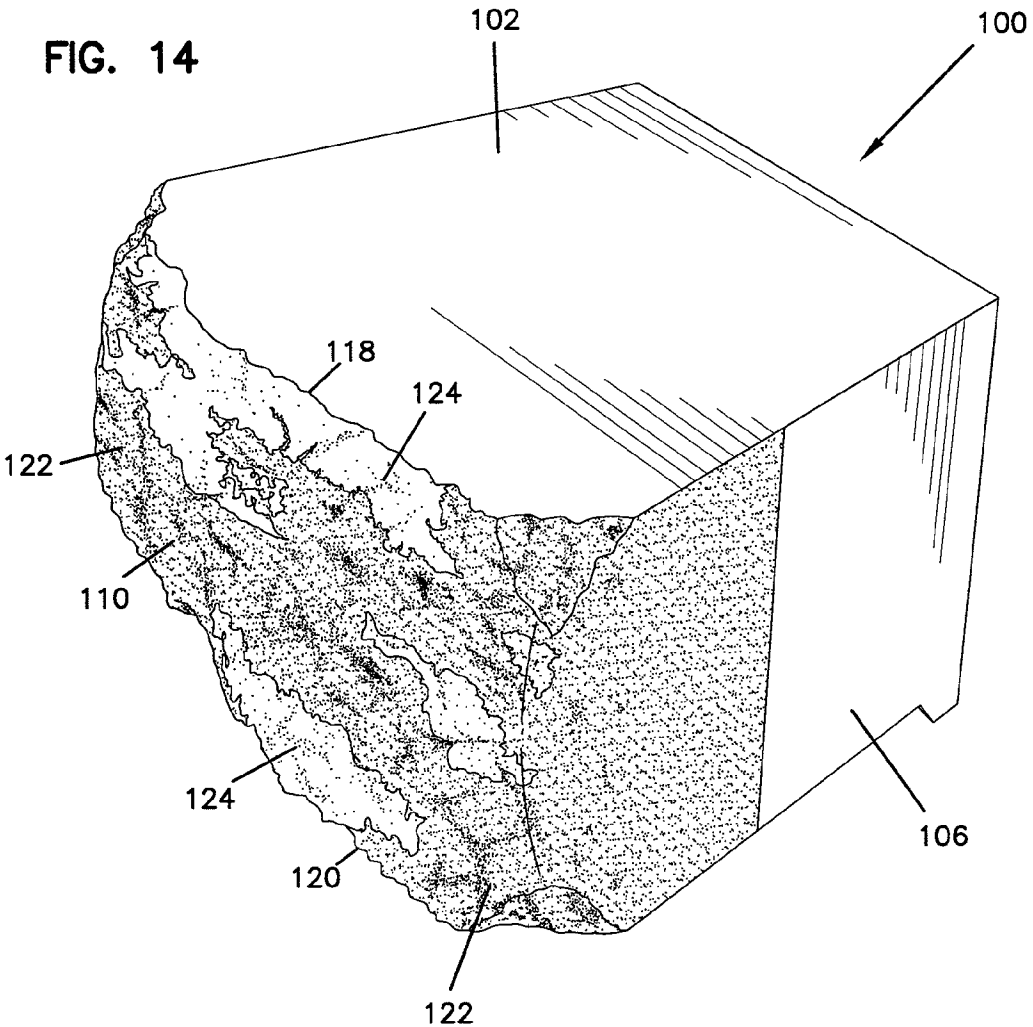
FIG. 14 is a perspective view of a masonry block that is split from a workpiece using top and bottom splitting blade assemblies of the type illustrated in FIGS. 8 and 11.
Figure 15:
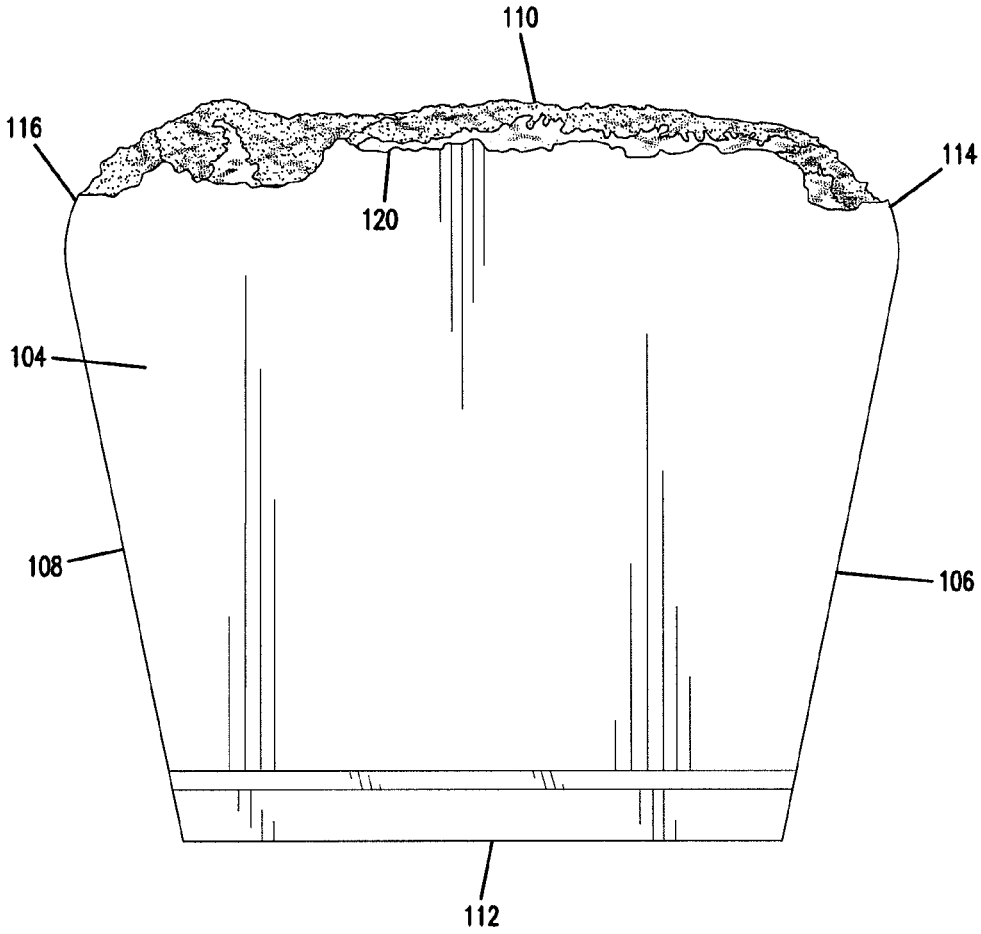
FIG. 15 is a bottom plan view of the masonry block in FIG. 14.
Figure 16:
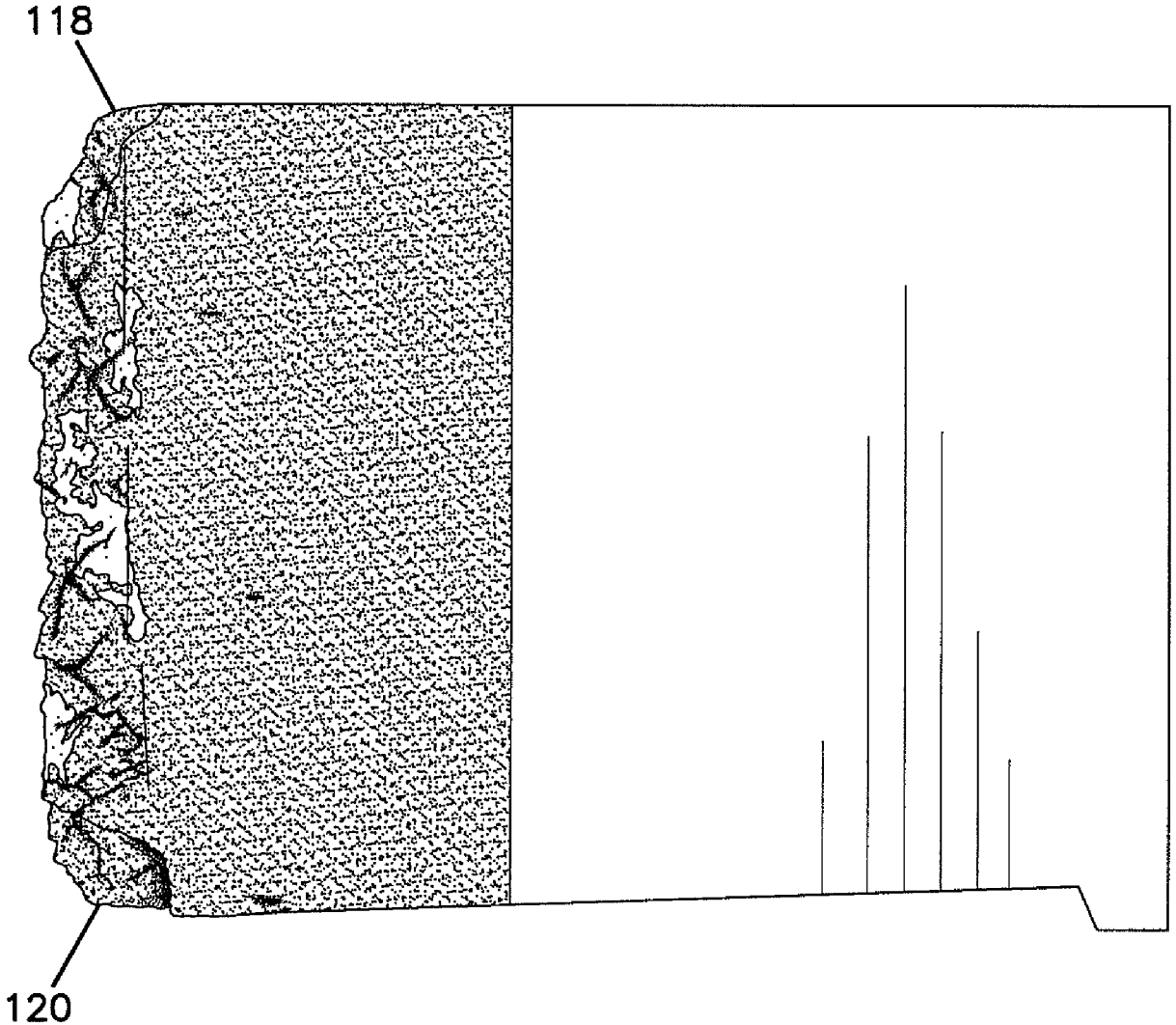
FIG. 16 is a side view of the masonry block of FIG. 14.

A masonry block 100 that results from a splitting process on the workpiece 68 using the splitting assemblies 12' and 22' of FIGS. 11 and 8, respectively, is shown in FIGS. 14-16. The masonry block 100 includes a block body with a generally flat top surface 102, a generally flat bottom surface 104, side surfaces 106, 108, a front surface 110 and a rear surface 112. The words "top" and "bottom" refer to the surfaces 102, 104 of the block after splitting and after the block is inverted from its lips-up orientation during splitting. In addition, the front surface 110 of the block 100 is connected to the side surfaces 106, 108 by radiused sections 114, 116. The radiused sections 114, 116 have a radius of about 1.0 inch as a result of the contoured regions 74-77 on the workpiece. In addition, due to the positioning of the projections 16 on the blade assembly 12 shown in FIG. 12, and the similar positioning of the projections 26 on the blade assembly 22, the upper left and right corners and the lower left and right corners of the block 100 at the radiused sections 114, 116 are removed during the splitting process.

The radiused sections 114, 116 serve several purposes. First, they present a more rounded, natural appearance to the block, as compared to a block in which the front face intersects the sides at a sharp angle. Second, in the case of the sharply angled block, the splitting/distressing action produced by the splitting blade assemblies described here can break off large sections of the corners, which can create fairly significant gaps in the walls. Contact between adjacent blocks in a wall is often sought in order to act as a block for back fill material, such as soil, that may seep through the wall, as well as to eliminate gaps between adjacent blocks which is generally thought to detract from the appearance of the wall. If suitable precautions, such as the placement of filter fabric behind the wall, are not used, the fine soils behind the wall will eventually seep through the wall. The use of radiused section 114, 116 appears to minimize the corner breakage to an acceptable degree, so as to preserve better contact or abutment surfaces with adjacent blocks in the same course when the blocks are stacked to form a wall.

Figure 17:
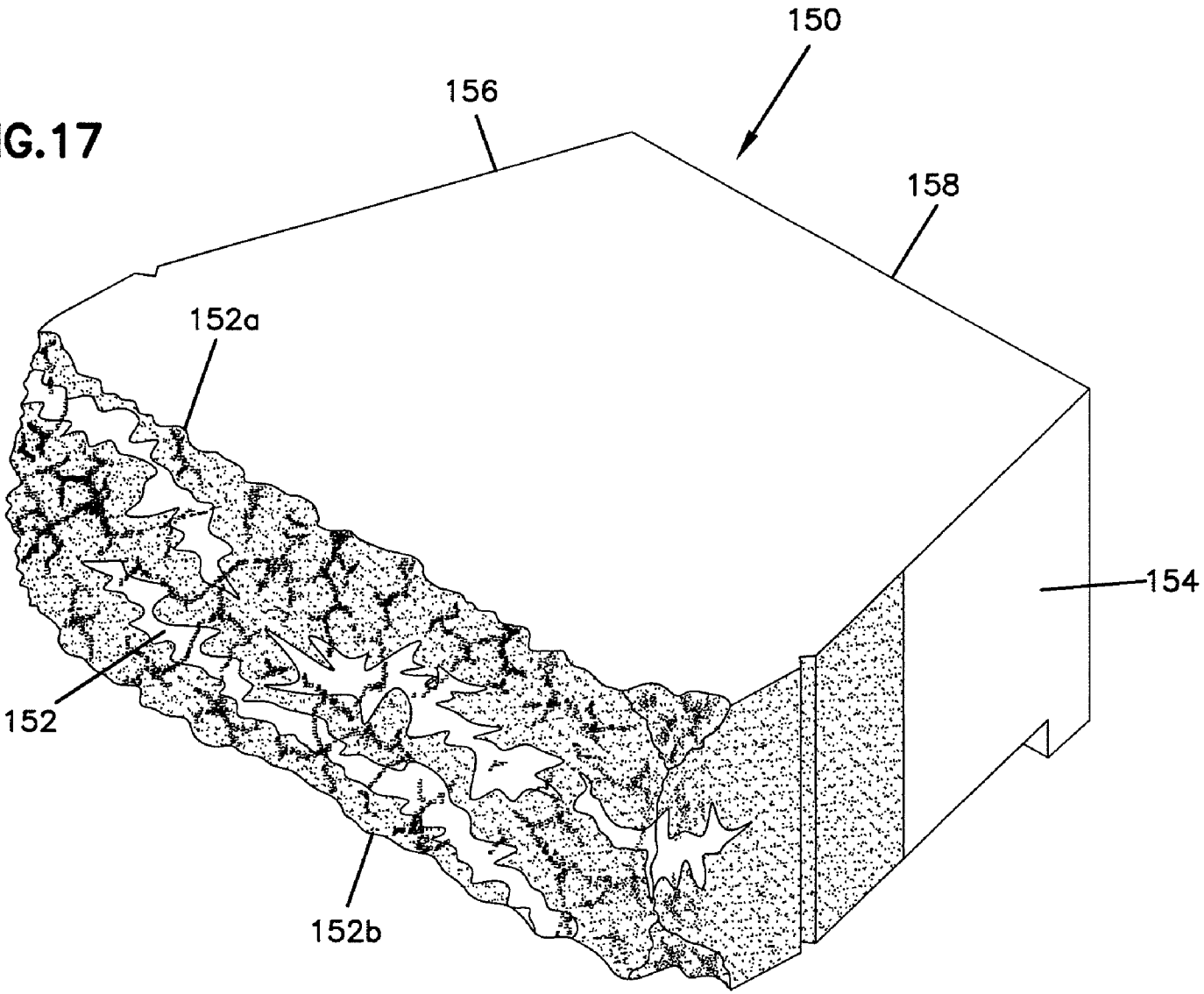
FIG. 17 is a perspective view of an alternative embodiment of a masonry block that has been split according to the present invention.

In the blocks of FIGS. 14-16, the top and bottom surfaces 102, 104 do not have to be completely planar, but they do have to be configured so that, when laid up in courses, the block tops and bottoms in adjacent courses stay generally parallel to each other. Further, the front surface 110 of each block is wider than the rear surface 112, which is achieved by converging at least one of the side surfaces 106, 108, preferably both side surfaces, toward the rear surface. Such a construction permits inside radius walls to be constructed. It is also contemplated that the side surfaces 106, 108 can start converging starting from a position spaced from the front surface 110. This permits adjacent blocks to abut slightly behind the front face, which in turn, means that it is less likely that fine materials behind the wall can seep out through the face of the wall. Such a block shape is shown in FIG. 17.

The front surface 110 of the block has a roughened, rock-like texture. In addition, an upper edge 118 and a lower edge 120 of the front surface 110 are also roughened as a result of the projections 16, 26 on the splitting blade assemblies 12, 22. As a result, the front surface 110 and the edges 118, 120 are provided a roughened, rock-like appearance. Further, the entire front surface 110 is slightly rounded from top to bottom when viewed from the side. The edges 118, 120 are also rounded.

FIGS. 14 and 16 also illustrate the radiused sections 114, 116 and at least a portion of the side surfaces 106, 108 as being lightly textured. The light texturing is achieved using a horizontal groove or channel that is formed in the mold walls at the locations where light texturing on the workpiece and resultant block is desired.

Figure 19:
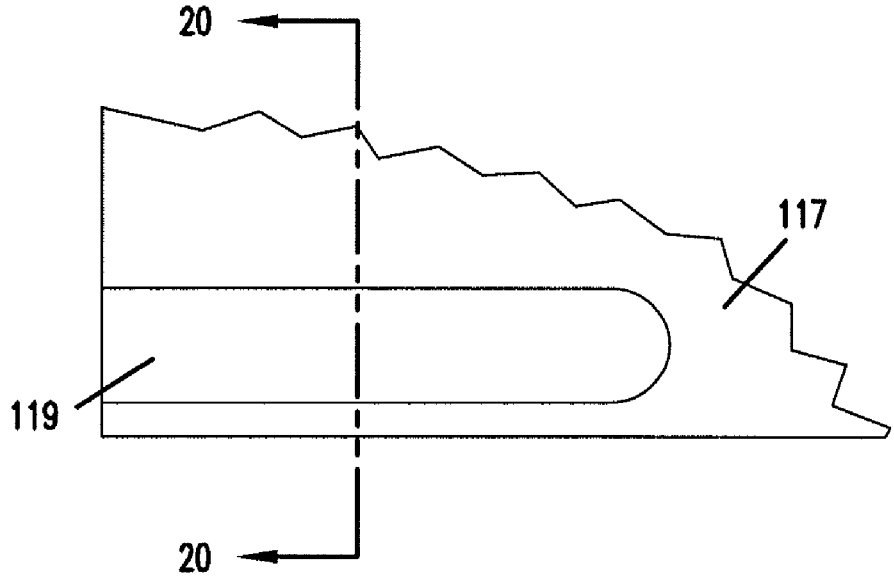
FIG. 19 is a front view of a mold wall in which a single horizontal groove or channel has been cut in the wall close to the bottom of the wall.
Figure 20:
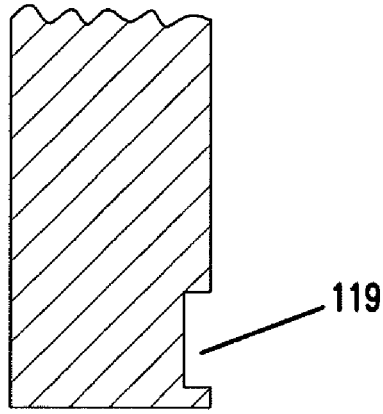
FIG. 20 is a sectional view of the mold wall shown in FIG. 19 taken at line 20-20 to show the cross section of the groove.

FIG. 19 illustrates a portion of a mold wall 117 from the mold 84 in FIG. 13 having a generally horizontal channel or groove 119 provided in the wall close to the bottom of the wall. FIG. 20 is a cross sectional view of the wall 117 showing the shape of the channel 119. The mold wall 117 corresponds to one of the surfaces of the block that is to be lightly textured, such as the side surface 106. The channel 119 is illustrated as extending along a portion of the wall 117, in which case light texturing of only a portion of the corresponding surface of the workpiece will occur. However, the channel 119 can extend along the entire length of the wall 117 if light texturing is desired along the entire corresponding surface.

The channel 119 is illustrated as being rectangular in cross section. However, other shapes can be used such as semi-circular, v-shaped, or ear-shaped, and multiple grooves or channels can be used. These multiple grooves or channels can be at the same or different heights on the mold wall. The channels may be generally parallel to the bottom of the mold or they may be skewed or even non-linear such as serpentine. Criss-cross patterns can be used. The channel 119 preferably has a height of about 0.50 inches, a depth of about 0.060 inches, and the channel 119 begins about 0.090 inches from the bottom of the wall 117. Other channel dimensions, in addition to channel shapes, could be used, with variations in the resulting light texturing that is produced.

It has been discovered that the provision of the channel 119 causes texturing of the corresponding surface of the molded workpiece as it is discharged from the mold. Although not wishing to be bound to any theory, it is believed that some of the fill material used to form the workpiece temporarily resides in the channel 119 during the molding process. This is referred to as "channel fill material". As the compressed and molded fill material is discharged from the mold cavity, this channel fill material begins to be disturbed or disrupted by the movement of the workpiece within the mold cavity and the channel fill material is caused to tumble or roll against the passing surface of the workpiece, imparting a slightly rough texture to it. It seems likely that the channel fill material is constantly being changed/replenished as the workpiece passes by the channel during discharge of the workpiece from the mold. Regardless of the mechanism, the surface of the passing workpiece is given a slightly rough texture by this process.

Further details on molds and grooves or channels in mold walls to achieve texturing can be found in co-pending U.S. patent application Ser. Nos. 09/691,931 and 09/691,898, each of which was filed on Oct. 19, 2000, and which are incorporated herein by reference in their entirety.

Preferably, at least the radiused sections 114, 116 and the front portion of the side surfaces 106, 108 are lightly textured. This is important because the roughening caused by the projections 16, 26 can expose portions of the block sides when the blocks are laid up in a wall. The light texturing of these side surfaces has the effect of disguising the manufactured appearance of the exposed portions of the blocks. If no light texturing is employed, then the generally smooth, somewhat shiny sides of the blocks tend to look very manufactured. It is preferred that the light texturing be produced along about 3.0 to about 8.0 inches of each block side, extending over each radiused portion and a portion of each side surface, as measured from the front surface of a 12 inch long block. However, it is contemplated and within the scope of the invention to lightly texture more of the side surfaces than just the front portions thereof, including the entirety of the side surfaces, and to lightly texture the rear surface 112.

The material used to form the masonry block 100 is preferably a blended material to further add to the natural, weathered rock-like appearance. As is known in the art, fill materials that are used to make blocks, bricks, pavers and the like, contain aggregates such as sand and gravel, cement and water. Fill materials may contain pumice, quartzite, taconite, and other natural or man-made fillers. They may also contain other additives such as color pigment and chemicals to improve such properties as water resistance, cure strength, and the like. The ratios of various ingredients and the types of materials and sieve profiles can be selected within the skill of the art and are often chosen based on local availability of raw materials, technical requirements of the end products, and the type of machine being used.

Preferably, the fill material that is used to form the block 100 is formulated to produce a blend of colors whereby the resulting front face 110 of the split block 100 has a mottled appearance so that the front of the block simulates natural stone or rock. For instance, as shown in FIG. 14, the front face 110 has a mottled appearance produced by a plurality of colors 122, 124. One or more additional colors could be added in order to alter the mottled appearance. However, in instances when a mottled appearance is not desired, a single color fill material or a natural aggregate mix could be used.

Figure 21:
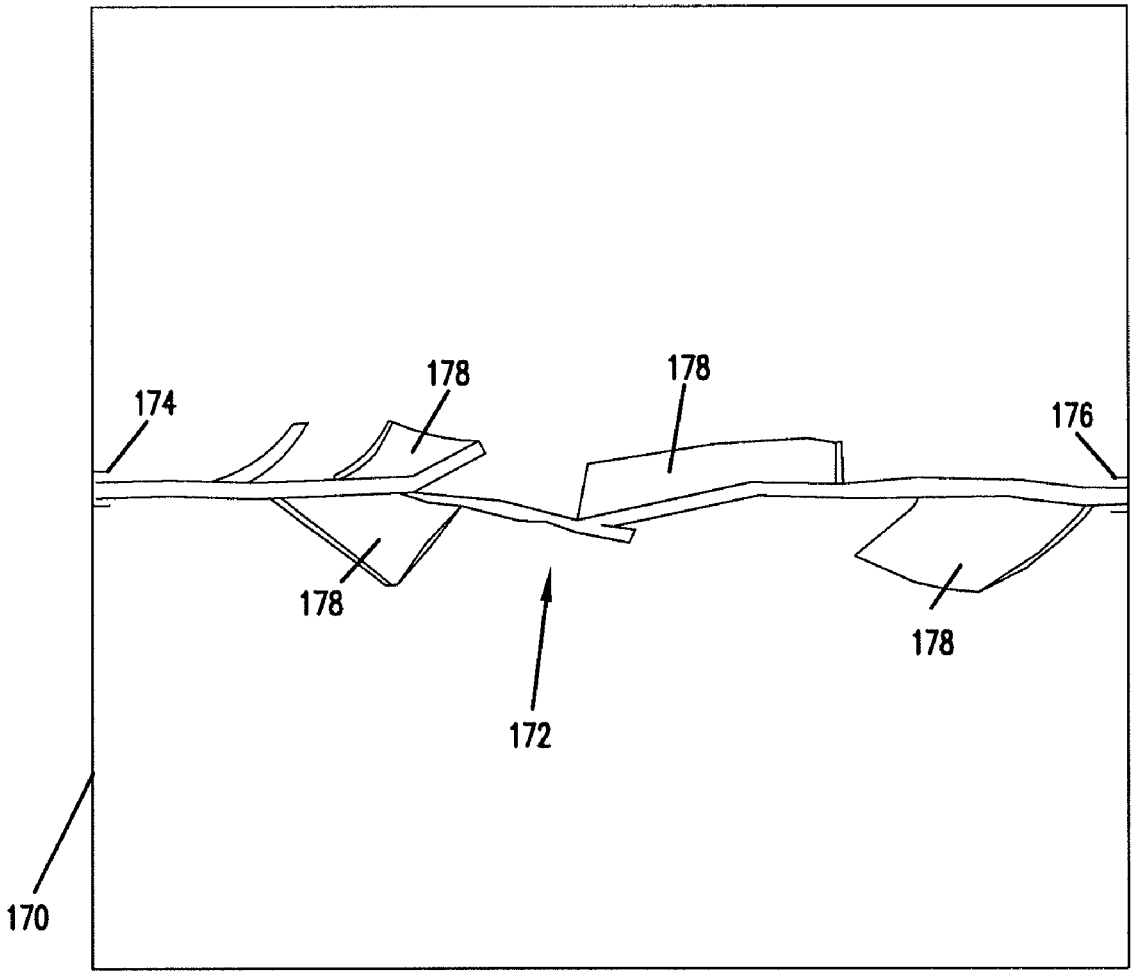
FIG. 21 is a top view of a hopper and partition plate for swirling the colors of the fill material.

When a mottled appearance is sought, the fill material that is used to form the workpiece and thereby the resulting block (s) is preferably introduced into the mold using a divided gravity hopper and a feedbox, which are known in the art, above the mold. FIG. 21 shows a top view of a hopper 170 and a partition plate 172 that is mounted in the hopper 170 to help produce a swirling of colors in the fill material. The partition plate 172 extends across the width of the hopper 170, with the edges of the plate 172 being removably disposed within channels 174, 176 formed on the hopper to enable removal of the plate 172. The plate 172 also extends vertically within the hopper 170.

The plate 172 is comprised of an arrangement of baffles 178 that are intended to randomly distribute each fill material color as it is poured into the hopper 170. Each fill material color is poured separately into the hopper, with the plate 172 randomly distributing each color onto any material previously poured into the hopper. The sucking action of the feedbox on the hopper as fill material is discharged into the feedbox further contributes to a random distribution of the various colors in the fill material. Moreover, an agitator grid, which is known in the art, is present in the feedbox for leveling the fill material. The action of the agitator grid also contributes to the swirling of the colors in the fill material.

The fill material with the randomly distributed or swirled colors is then transferred from the feedbox into the mold to produce the workpiece. The swirling of the colors in the fill material produces the mottled appearance on the front surface of the block 100 once the workpiece is split. The swirling produced by the plate 172, the sucking action of the feedbox, and the agitator grid is random, so that the swirling of colors in each workpiece and the resulting mottled appearance on each block, is generally different for each workpiece and block formed. In addition, the mottled appearance of the front surface will vary depending upon where the workpiece is split due to the random swirling of the colors in the workpiece.

An example of a composition, on a weight basis, of one fill material that can be used to produce a mottled appearance using a 3-color blend is as follows:

| Gray (½ batch) | Charcoal (½ batch) | Brown (½ Batch) |
|---|---|---|
| Sand 2500 | 2500 | 2500 |
| Buckshot 1000 | 1000 | 1000 |
| Cement 275 | 275 | 275 |
| Flyash 100 | 100 | 100 |
| | Additives: | |
| RX-901 19oz. | RX-901 19oz. | RX-901 19oz. |
| | Color: | |
| No color added | Black 330 3.75 lbs. | Red 110 5.10 lbs<br>Black 330 5.10 lbs |

RX-901, manufactured by Grace Products, is a primary efflorescence control agent that is used to eliminate the bleeding of calcium hydroxide or "free lime" through the face of the block.

Other fill material compositions could be used as well depending upon the desired mottled appearance of the block front face, the above listed composition being merely exemplary. For instance, a two-color fill material could be used.

Once the fill material has been prepared, it is transported to the block forming machine, and introduced into the mold in the commonly understood fashion. The block forming machine forms "green", uncured workpieces, which are then transported to a curing area, where the workpieces harden and gain some of their ultimate strength. After a suitable curing period, the workpieces are removed from the kilns, and introduced to the splitting station, adapted as described above, where the workpieces are split into individual blocks. From the splitting station, the blocks are transported to a cubing station, where they are assembled into shipping cubes on wooden pallets. The palletized cubes are then transported to an inventory yard to await shipment to a sales outlet or a jobsite.

The block 100 also includes a locator lip or flange 126 formed integrally on the bottom surface 104 adjacent to, and preferably forming a portion of, the rear surface 112. The lip 126 establishes a uniform set back for a wall formed from the blocks 100, and provides some resistance to shear forces. In the preferred configuration, the lip 126 is continuous from one side of the block 100 to the other side. However, the lip 126 need not be continuous from one side to the other side, nor does the lip 126 need to be contiguous with the rear surface 112. A different form of protrusion that functions equivalently to the lip 126 for locating the blocks could be used.

The block shape shown in FIGS. 14-16 is preferred. However, it is contemplated and within the scope of the invention to utilize the concepts described herein, including the roughened edges produced by the projections 16, 26, and/or the light texturing of the side surfaces, and/or the mottled appearance of the front surface, on other block shapes. In addition, the block 100 could be formed with internal voids to reduce the weight of the block 100.

For example, FIG. 17 illustrates a block 150 that is provided with a roughened front face 152 with roughened edges 152*a*, 152*b*, light texturing of a portion of side surfaces 154, 156 (only one side surface 154 and the light texturing thereon is visible in FIG. 16), and a mottled coloration of the front face 152. Like the block 100, the entirety of the side surfaces 154, 156, as well as a rear surface 158, could be lightly textured. The block 150 is preferably split from a suitable workpiece using the splitting assemblies 12' and 22' of FIGS. 11 and 8, respectively. The general shape of the block 150 is similar to that disclosed in FIGS. 1-3 of U.S. Pat. No. 5,827,015. Other block shapes could be provided with one or more of these features as well.

In the preferred embodiment, the block 100 is one of a pair of blocks that results from splitting a workpiece, such as the workpiece 68 in FIG. 12, using splitting blade assemblies of the type illustrated in FIGS. 8 and 11. Different block sizes can be formed by reducing or enlarging the size of the workpiece from which the blocks are produced. However, as discussed above with respect to FIG. 10, the workpiece 58 could be formed and then split to produce three different block sizes, each of which is similar to the block 100. In addition, it is contemplated and within the scope of the invention that a single one of the blocks 100 could be formed from a workpiece that, after splitting, results in a waste piece in addition to the block 100.

Figure 18:
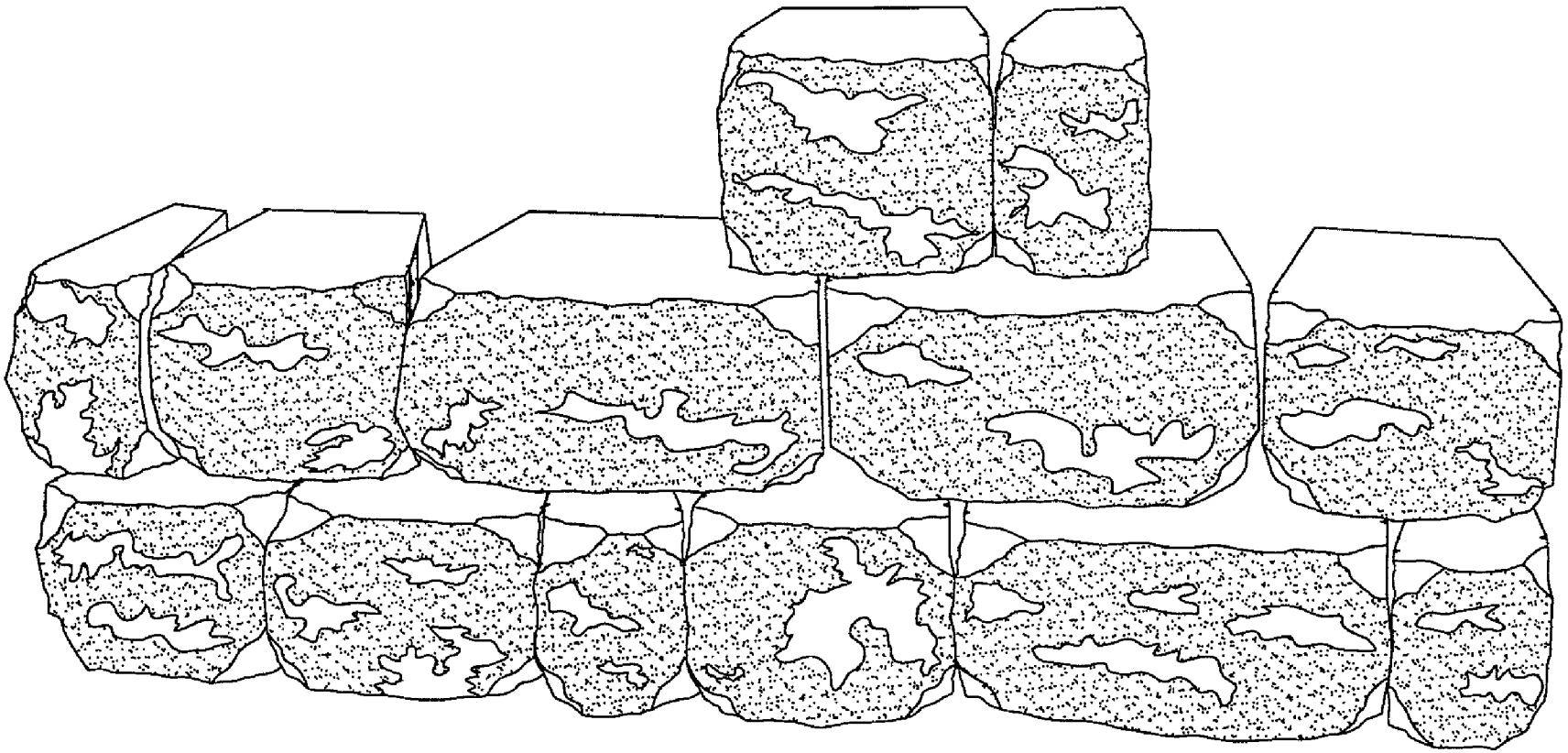
FIG. 18 illustrates a wall constructed from differently sized blocks that have been split according to the invention.

FIG. 18 illustrates a wall constructed from three differently sized blocks, with each block having a configuration similar to the block 100.

There may be instances when it is satisfactory that a block be provided with only one roughened edge on the front face. Therefore, it is contemplated and within the scope of the invention that a workpiece could be split using a single one of the splitting assemblies described herein.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A block splitter assembly configured to engage a work piece and split it into two blocks, during a splitting operation; the block splitter assembly comprising:

first and second, opposed, splitting blade assemblies;

the first splitting blade assembly having: a first splitting blade having first and second, opposite, sides;

at least a first projection positioned at the first side of, and spaced from, the first splitting blade at a location to engage a work piece during a splitting operation; and, at least a second projection positioned at the second side of, and spaced from, the first splitting blade at a location to engage a work piece during a splitting operation; and, the second splitting blade assembly having: a second splitting blade having first and second, opposite, sides;

at least a third projection positioned at the first side of, and spaced from, the second splitting blade at a location to engage a work piece during a splitting operation; and, at least a fourth projection positioned at the second side of, and spaced from, the second splitting blade at a location to engage a work piece during a splitting operation; and, the first and second splitting blades being oriented opposed to one another to converge on, and strike, a work piece to split the work piece into two resulting split pieces; and, the first, second, third and fourth projections being positioned to engage the work piece to contribute to formation of at least one irregular split edge on at least one surface of each one of the two resulting split pieces.

2. A block splitter assembly according to claim 1 wherein:

the first projection has an extent of vertical extension that is less than an extent of vertical extension of the first splitting blade; and, the second projection has an extent of vertical extension that is less than an extent of vertical extension of the first splitting blade.

3. A block splitter assembly according to claim 2 wherein:

the first splitting blade is a straight blade.

4. A block splitter assembly according to claim 3 wherein:

the second splitting blade is a straight blade.

5. A block splitter assembly according to claim 4 wherein:

the first splitting blade is a continuous blade.

6. A block splitter assembly according to claim 5 wherein:

the second splitting blade is a continuous blade.

7. A block splitter assembly according to claim 1 including:

a point on a top surface of the first projection; and, a point on a top surface of the second projection.

8. A block splitter assembly according to claim 7 including:

a point on a top surface of the third projection; and, a point on a top surface of the third projection.

9. A block splitter assembly according to claim 6 wherein:

the first projection comprises a portion of a projection arrangement that does not define a straight line; and, the second projection comprises a portion of a projection arrangement that does not define a straight line.

10. A block splitter assembly according to claim 9 wherein:

the first projection comprises one of a plurality of projections at the first side of the first splitting blade; and, the second projection comprises one of a plurality of projections at the second side of the first splitting blade.

11. A block splitter assembly according to claim 1 wherein:

the first splitting blade is a straight blade.

12. A block splitter assembly according to claim 11 wherein:

the first splitting blade is a continuous blade.

13. A block splitter assembly according to claim 1 wherein:

the first projection comprises one of a plurality of projections at the first side of the first splitting blade; and, the second projection comprises one of a plurality of projections at the second side of the first splitting blade.

14. A block splitter assembly according to claim 1 wherein:

the first projection comprises a portion of a projection arrangement that does not define a straight line; and, the second projection comprises a portion of a projection arrangement that does not define a straight line.

* * * * *